US008177326B2

(12) United States Patent
Samoto et al.

(10) Patent No.: US 8,177,326 B2
(45) **Date of Patent: *May 15, 2012**

(54) IMAGE RECORDING APPARATUS

(75) Inventors: Kenji Samoto, Nagoya (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 716 days.

This patent is subject to a terminal disclaimer.

(21) Appl. No.: 11/616,851

(22) Filed: Dec. 27, 2006

(65) Prior Publication Data

US 2007/0146421 A1 Jun. 28, 2007

(30) Foreign Application Priority Data

Dec. 28, 2005 (JP) ..... 2005-377525

(51) Int. Cl.
*B41J 23/00* (2006.01)
*B41J 2/015* (2006.01)

(52) U.S. Cl. ..... 347/37; 347/20

(58) Field of Classification Search ..... 347/37, 347/84, 20; 345/20, 37
See application file for complete search history.

(56) References Cited

U.S. PATENT DOCUMENTS

| | | | | |
|---|---|---|---|---|
| 5,593,240 | A * | 1/1997 | Broder et al. | 400/352 |
| 6,789,966 | B2 | 9/2004 | Tanaka et al. | |
| 7,547,091 | B2 * | 6/2009 | Hashii et al. | 347/37 |
| 2002/0146266 | A1 | 10/2002 | Tanaka et al. | |
| 2005/0195242 | A1 | 9/2005 | Samoto et al. | |
| 2005/0243125 | A1 | 11/2005 | Ishikawa | |
| 2007/0146419 | A1 | 6/2007 | Samoto et al. | |
| 2007/0165066 | A1 * | 7/2007 | Samoto et al. | 347/37 |

FOREIGN PATENT DOCUMENTS

| | | | |
|---|---|---|---|
| JP | H05-270091 | A | 10/1993 |
| JP | H09-240100 | A | 9/1997 |
| JP | 2002-254746 | A | 9/2002 |
| JP | 2002-246907 | A | 9/2005 |
| JP | 2005-313492 | A | 11/2005 |
| JP | 2007-176022 | A | 7/2007 |
| JP | 2007-176024 | A | 7/2007 |

OTHER PUBLICATIONS

U.S. Appl. No. 11/616,648, claiming priority to Japanese Patent Application No. 2005-377526.
U.S. Appl. No. 11/615,527, claiming priority to Japanese Patent Application No. 2005-377524.
United States Patent and Trademark Office, Office Action received in corresponding U.S. Appl. No. 11/615,527, mailed on Oct. 19, 2009.

* cited by examiner

*Primary Examiner* — Jason Uhlenhake
(74) *Attorney, Agent, or Firm* — Baker Botts L.L.P.

(57) ABSTRACT

An image recording apparatus includes a carriage which carries a recording head and moves reciprocally in a main scanning direction; and a first support member and a second support member arranged on an upstream side and a downstream side, respectively, in a sub-scanning direction, the first support member and the second support member having a first slide surface and a second slide surface, respectively, for supporting the carriage slidably, the second support member having a third slide surface orthogonal to the second slide surface and positioned between the first slide surface and the second slide surface, and the carriage having one pair of first slidable projection sections slidable in contact with the third slide surface and one pair of second slidable projection sections facing the first slidable projection sections with the third slide surface between them, and a resilient member for resiliently energizing the second slidable projection sections.

8 Claims, 15 Drawing Sheets

IMAGE RECORDING APPARATUS

CROSS-REFERENCE TO RELATED APPLICATION

This non-provisional application claims priority under 35 U.S.C. §119(a) on Patent Application No. 2005-377525 filed in Japan on Dec. 28, 2005, the entire contents of which are hereby incorporated by reference.

BACKGROUND

The present invention relates to an inkjet type image recording apparatus, and more specifically relates to the structure of a device for supporting a carriage carrying a recording head.

As disclosed in Japanese Patent Application Laid-Open No. 5-270091 (1993), for example, in a mainstream conventional image recording apparatus, in order to support a carriage carrying a recording head so that the carriage is movable reciprocally along a main scanning direction (hereinafter referred to as the "X-axis direction", an axis extending in the main scanning direction is called the X-axis), the carriage is supported slidably by a support shaft in the form of a round shaft.

Since the support shaft in the form of a round shaft has good dimensional precision and high rigidity, it is possible to decrease the variation in a so-called paper gap from the nozzle surface where nozzles are formed of the recording head to the surface of a recording medium, and therefore high-quality recorded images are easily obtained. However, the cost including a frame structure is high. Moreover, when removing the carriage from the shaft for maintenance, replacement or other reason, it is necessary to first detach the support shaft from the frame and then remove the carriage from the support shaft. The reverse procedure needs to be performed when mounting the carriage. Thus, there is a problem that it is very hard to mount the carriage.

As a prior art for solving the above problems, Japanese Patent Applications Laid-Open Nos. 2002-254746 and 2005-313492 disclose structures in which the plate-like first support member and second support member are arranged lengthwise in the main scanning direction on the upstream side and downstream side of a plate-like platen in a paper transport direction (a sub-scanning direction orthogonal to the main-scanning direction (hereinafter referred to as the "Y-axis direction, an axis extending in the sub-scanning direction is called the Y-axis), a recording head is provided on the lower surface of a carriage supported slidably over the first and second support members, and the carriage is joined to a part of an endless belt placed lengthwise in the main scanning direction so that the carriage is moved reciprocally by a carriage motor.

On the lower surface of the carriage, leg sections which come into contact (slidably) with slide surfaces formed on the upper surfaces of the first and second support members are provided to control a print gap (paper gap) between the recording head of the carriage and paper on the platen. Moreover, on the second support member located on the downstream side near the joint section of the carriage and the endless belt, a cut-and-raised part extending in a vertical direction (the Z-axis direction orthogonal to the X-axis and the Y-axis) is formed to control the orientation of the carriage so that the carriage does not turn about the vertical axis (hereinafter referred to as the Z-axis) when it is pulled and moved by the endless belt.

Further, the carriage disclosed in Japanese Patent Application Laid-Open No. 2002-254746 includes an ink cartridge. On the other hand, in an inkjet printer disclosed in Japanese Patent Application Laid-Open No. 2005-313492, an ink cartridge is placed in a stationary manner in the main body housing of a printer apparatus, and the ink cartridge and the carriage are joined with an ink supply tube.

SUMMARY

By the way, as shown in Japanese Patent Application Laid-Open No. 2005-313492, a drive pulley is fixedly attached to a carriage motor (CR motor) fixed to the frame of the apparatus main body or one end of the second support member in the main scanning direction, and a driven pulley is rotatably attached to the other end in the main scanning direction. A part of the endless belt wound around the drive pulley and the driven pulley is joined to the carriage, and the carriage is moved reciprocally along the main scanning direction through the endless belt.

However, when starting to move the carriage, that is, when acceleration is given to the carriage, a tensile force of the endless belt acts on the joint section of the endless belt and the carriage. Therefore, moment to rotate the carriage about an axis in the vertical direction (the Z-axis direction) orthogonal to an axis in the main scanning direction (the X-axis direction) and an axis in the sub-scanning direction (the Y-axis direction) acts. Accordingly, the carriage turns or swings on a plane including the X-axis and the Y-axis, and thus the posture of the carriage is unstable during an image recording operation and there arises a problem that the quality of an image to be recorded may be deteriorated or unstable.

In the second support member of the inkjet printer disclosed in Japanese Patent Application Laid-Open No. 2005-313492, since the slide surface for supporting the carriage (namely, a surface for controlling the gap between the nozzle surface and the platen), a reference surface with respect to the height positions of the CR motor and the drive pulley and driven pulley for winding the endless belt, etc., and a reference surface with respect to the mount surface of a maintenance mechanism are substantially in the same plane, it is impossible to adjust the height position of center of gravity of the carriage in the vertical (Z-axis) direction and the height position of pulling the endless belt (the height position of the joint section of the endless belt and the carriage) to the most stable position in the Z-axis direction.

Therefore, in order to solve the problems associated with the prior arts, it is an object to provide an image recording apparatus which is constructed to facilitate the operation of attaching/detaching the carriage, enable a reduction in the manufacturing costs, and stabilize the posture of the carriage about an axis (Z-axis) in the vertical direction, without using a support shaft.

In order to achieve the object, an image recording apparatus according to a first aspect is characterized by an image recording apparatus comprising: a carriage which carries a recording head and moves reciprocally in a main scanning direction, said recording head having a nozzle and being capable of recording an image on a recording medium by ejecting ink from the nozzle; and a first support member and a second support member disposed on an upstream side and a downstream side, respectively, in a sub-scanning direction orthogonal to the main scanning direction, said first support member and said second support member having a first slide surface and a second slide surface, respectively, for supporting said carriage slidably, said first slide surface and said second slide surface being formed on substantially horizontal upper sides of the respective first support member and second support member to be parallel to a surface of said recording head where the nozzle is formed, wherein said second support member is provided with a third slide surface which stands substantially orthogonal to the second slide surface and is positioned between the first slide surface and the second slide surface, and said carriage comprises one pair of first slidable projection sections slidable in contact with the third slide surface and one pair of second slidable projection sections facing the first slidable projection sections with the third slide surface therebetween, at a suitable interval in the main scanning direction, and a resilient member for resiliently energizing the second slidable projection sections toward the third slide surface.

According to the first aspect, the second support member has a third slide surface formed between the first slide surface and the second slide surface in the sub-scanning direction to stand substantially orthogonal to the second slide surface. The carriage comprises one pair of first sidable projection sections sidable in contact with the third slide surface and one pair of second slidable projection sections facing the first slidable projection sections with the third slide surface therebetween, at a suitable interval in the main scanning direction, and a resilient member for resiliently energizing the one pair of second slidable projection sections toward the third slide surface. Thus, since the one pair of first slidable projection sections comes into contact with the third slide surface provided in the vertical direction (Z-axis direction) on the carriage, it is possible to receive rotational moment trying to rotate the carriage about the Z-axis through the joint section of the endless belt and the carriage with the tension of the endless belt, thereby producing the advantages effects of reducing the change in the posture of the carriage about the Z-axis and ensuring stable movement of the carriage in the main scanning direction.

The above and further objects and features will more fully be apparent from the following detailed description with accompanying drawings.

DETAILED DESCRIPTION OF THE EXEMPLARY EMBODIMENTS

Figure 1:
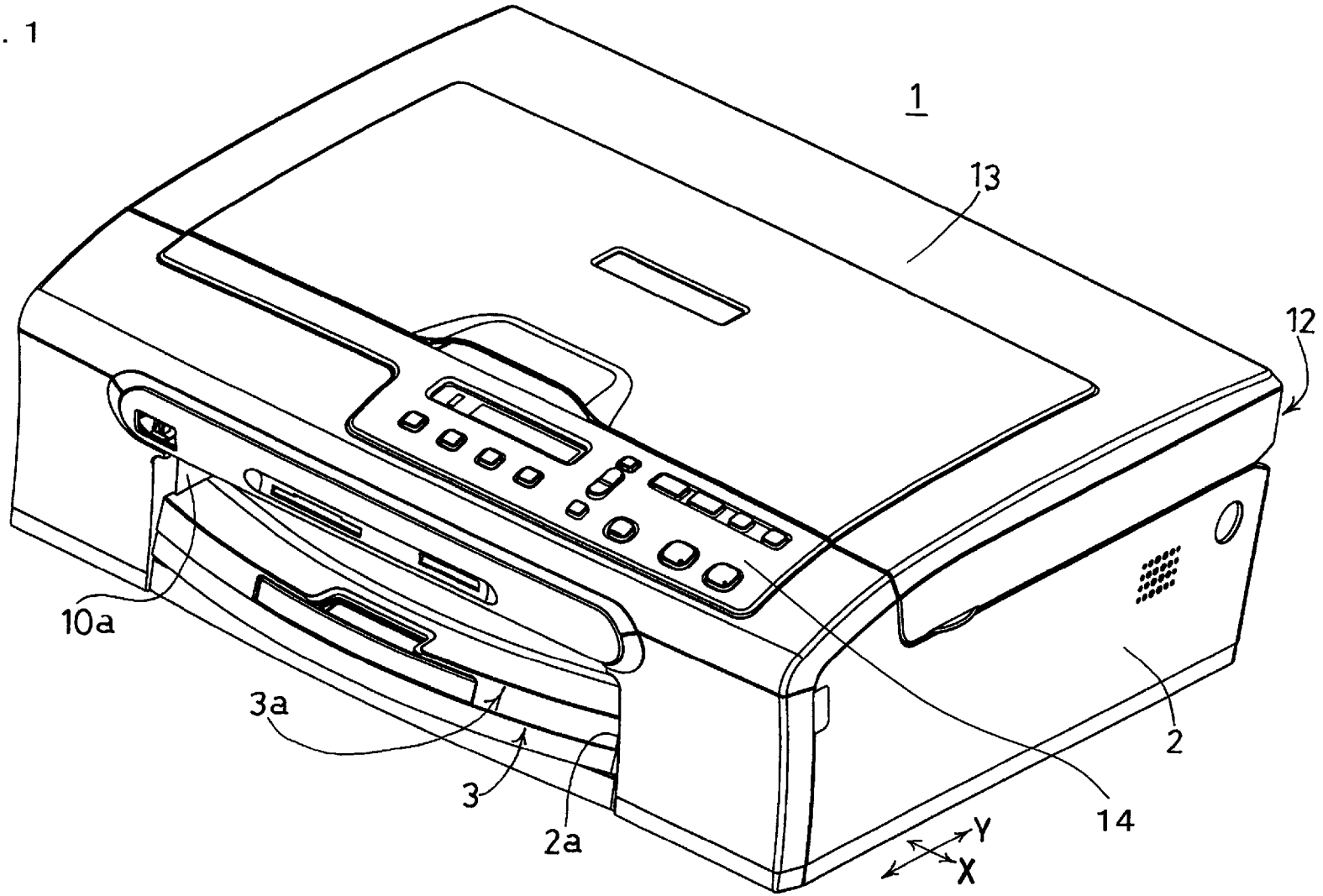
FIG. 1 is a perspective view of an image recording apparatus according to an embodiment.
Figure 2:
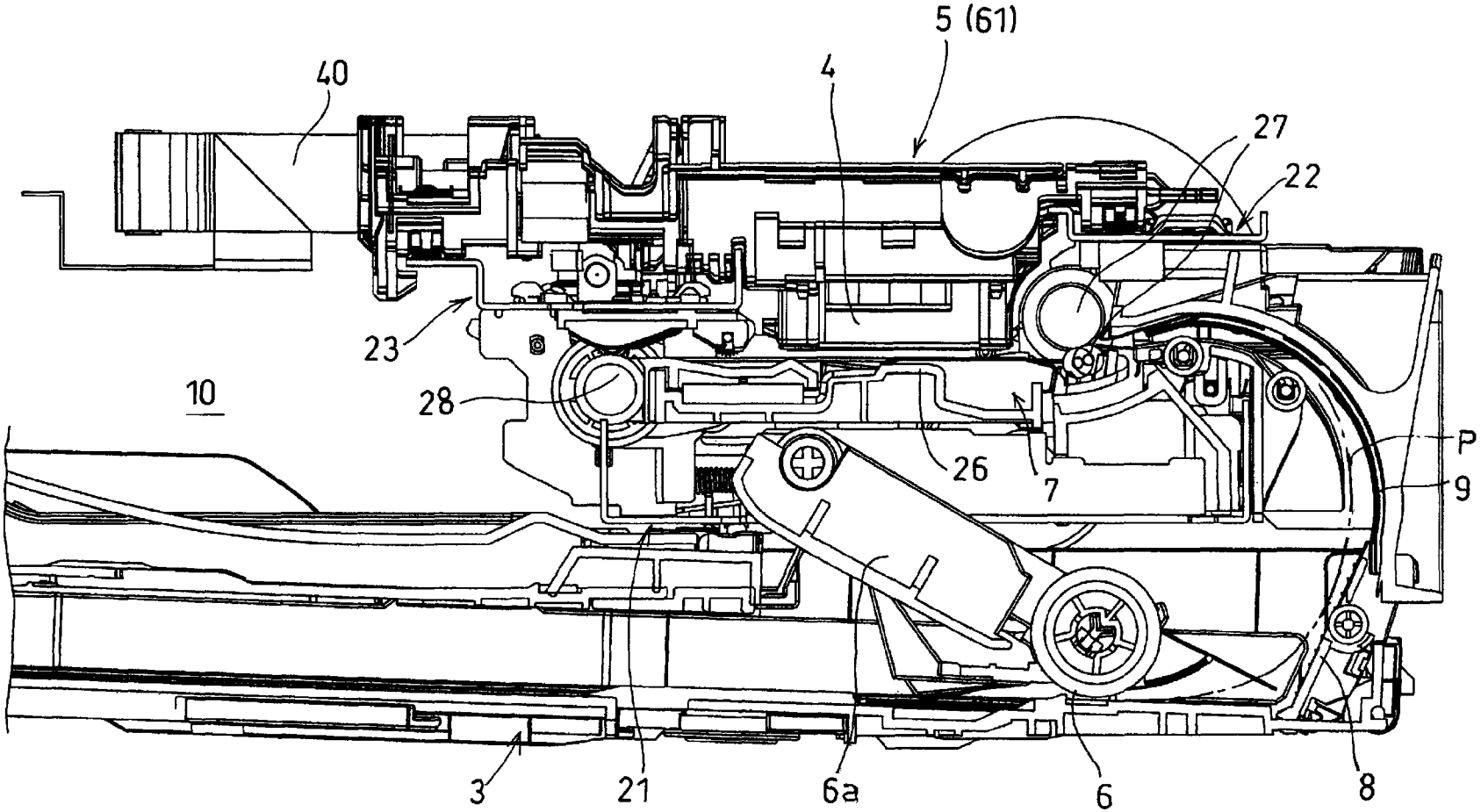
FIG. 2 is a sectional side view of a recording section and a paper feed cassette.
Figure 3:
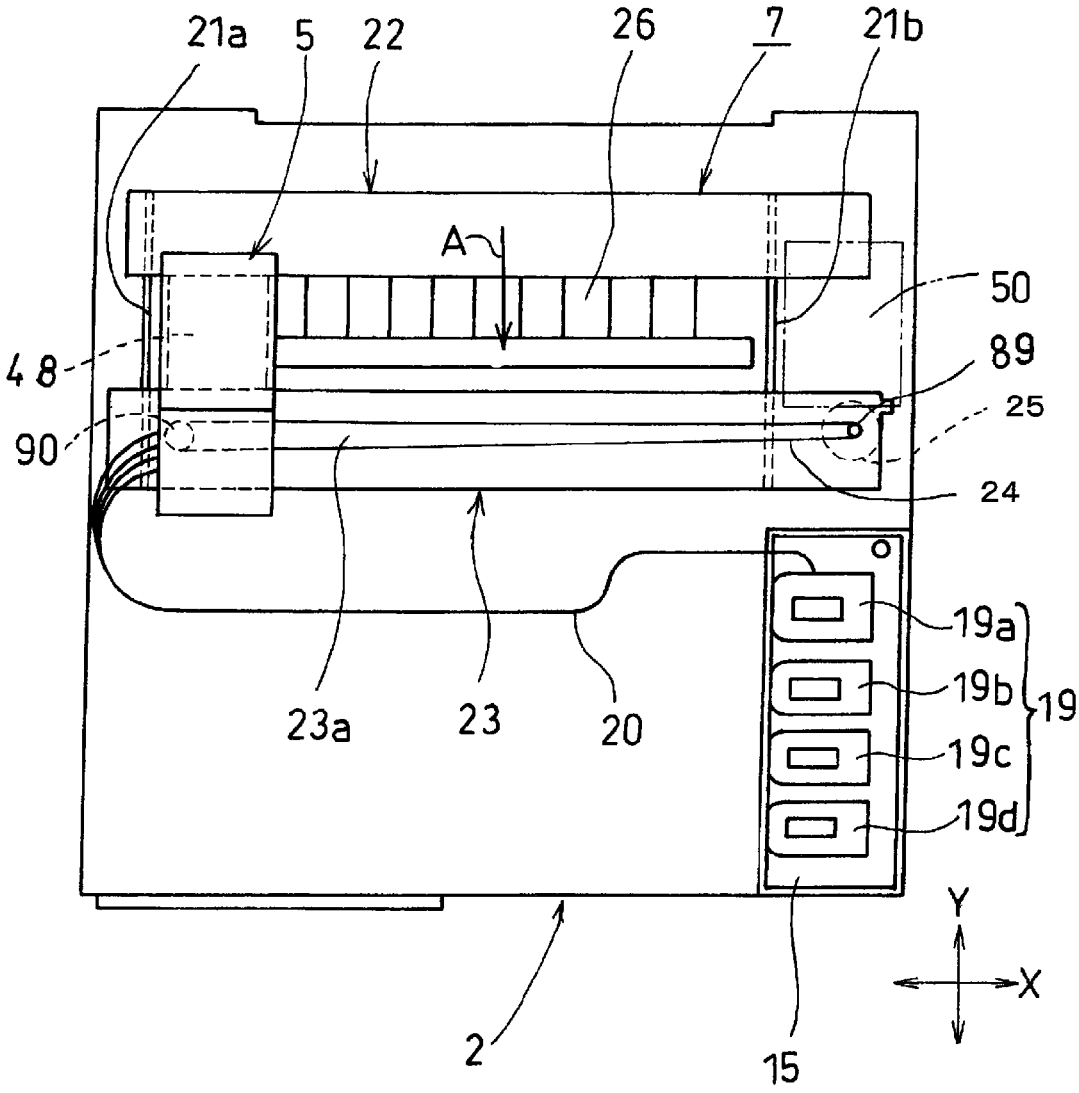
FIG. 3 is a plan view of the recording apparatus main body excluding an image reading device.
Figure 4:
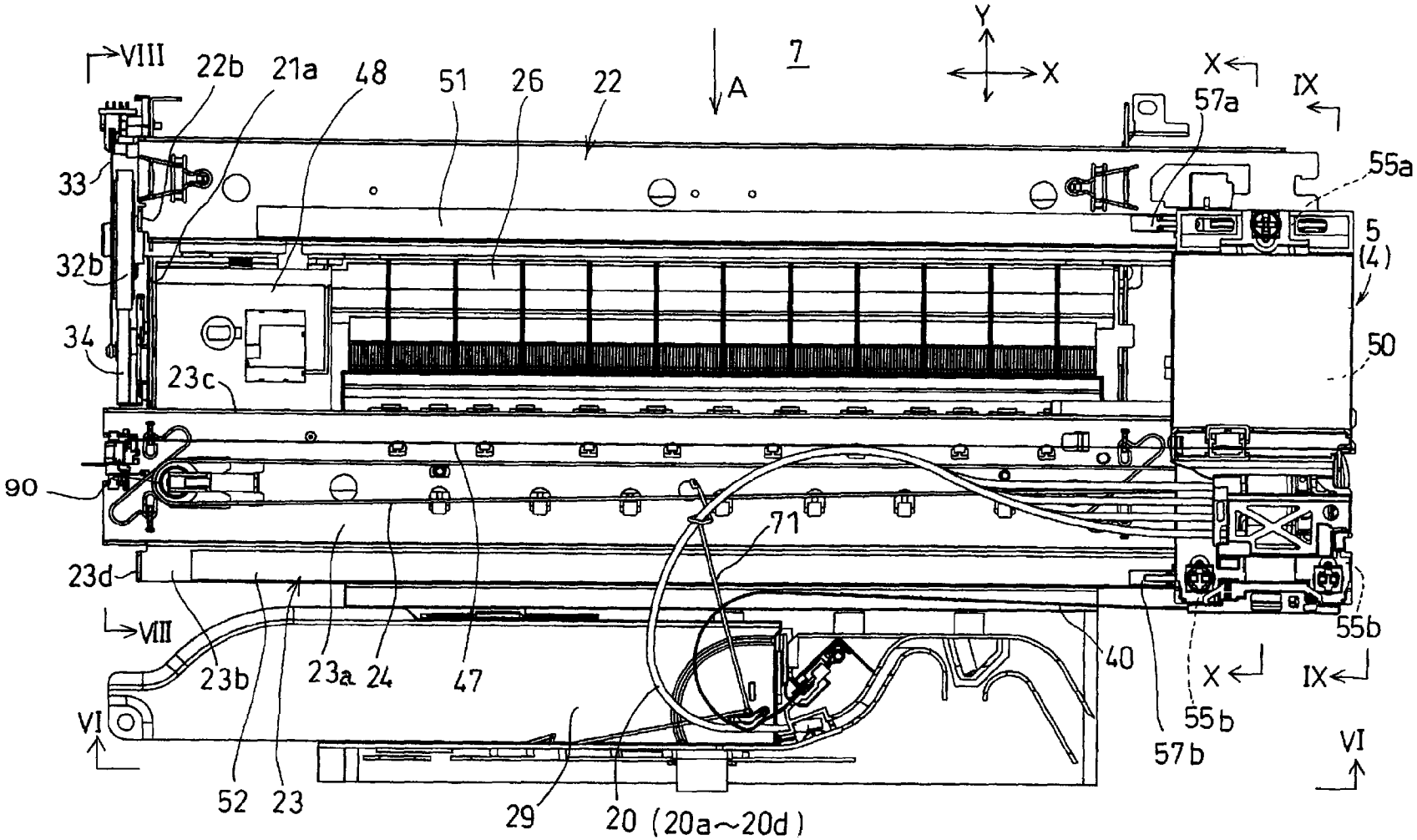
FIG. 4 is a plan view of a recording section.
Figure 5:
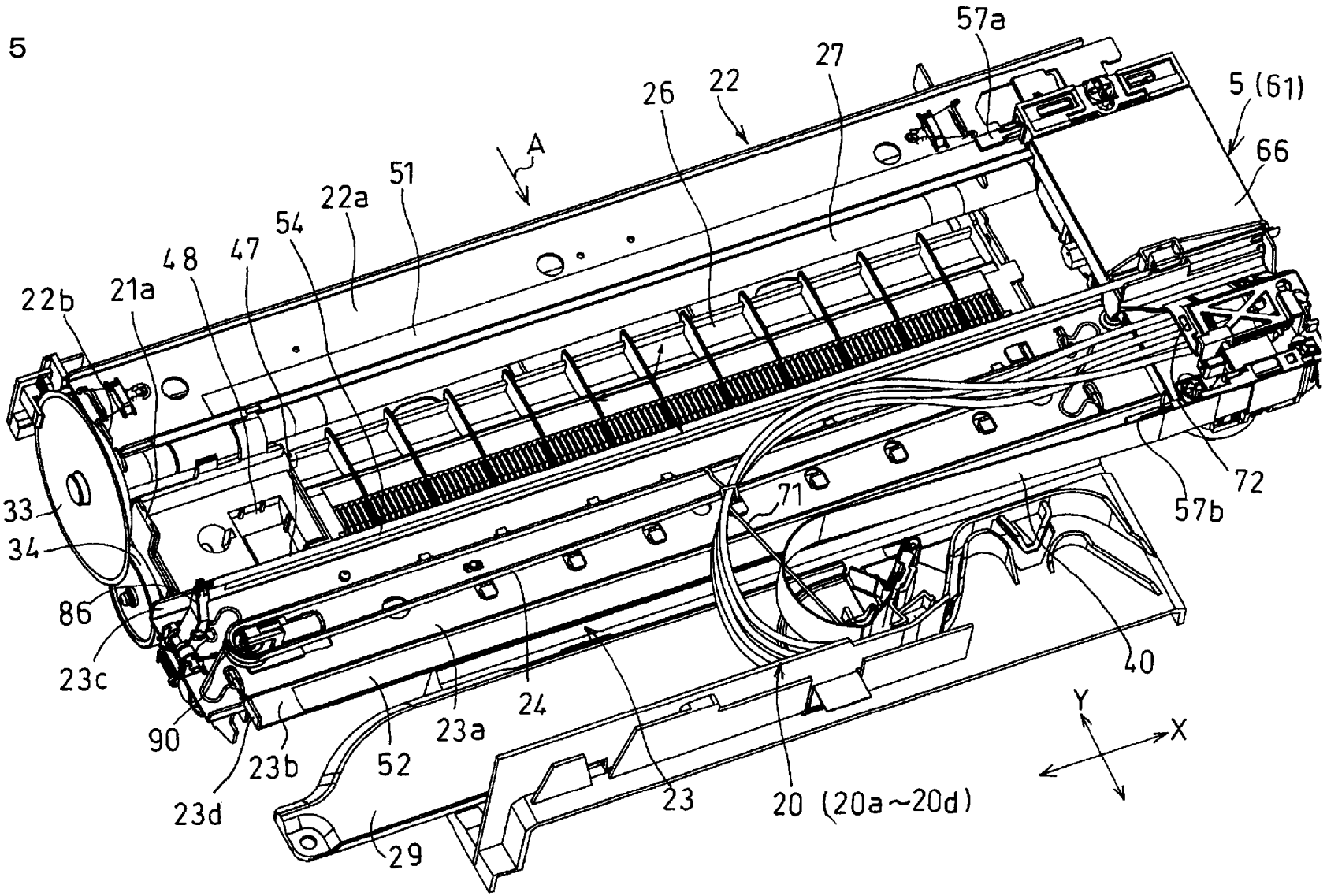
FIG. 5 is a perspective view of the recording section.
Figure 6:
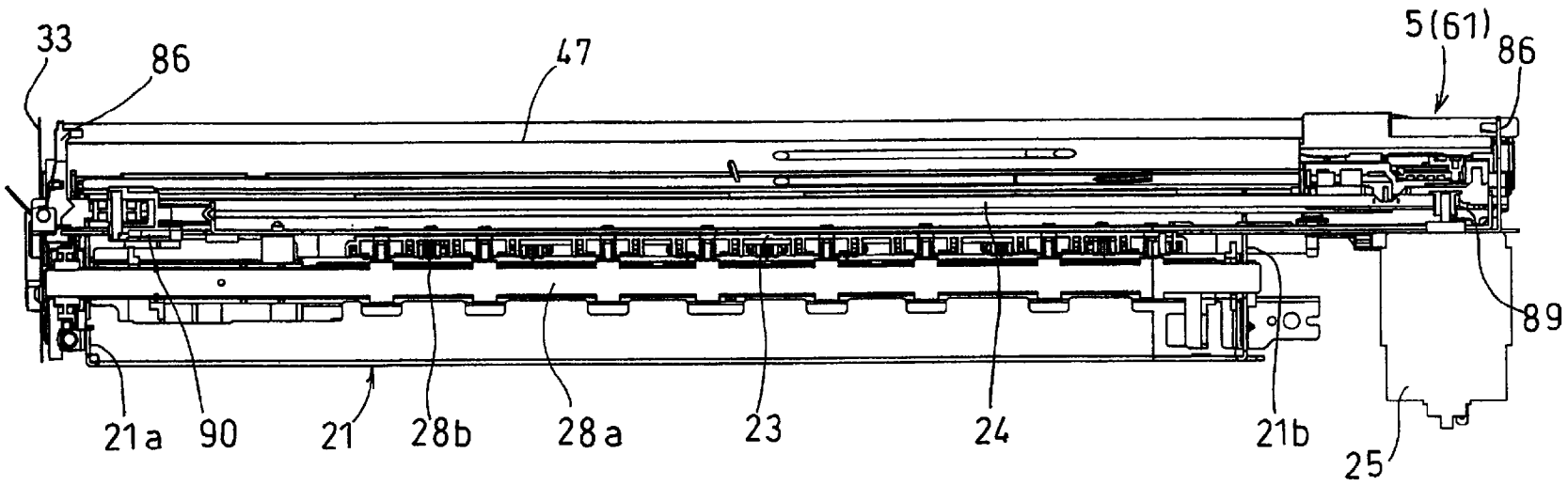
FIG. 6 is a view from the VI-VI line of FIG. 4.
Figure 7:
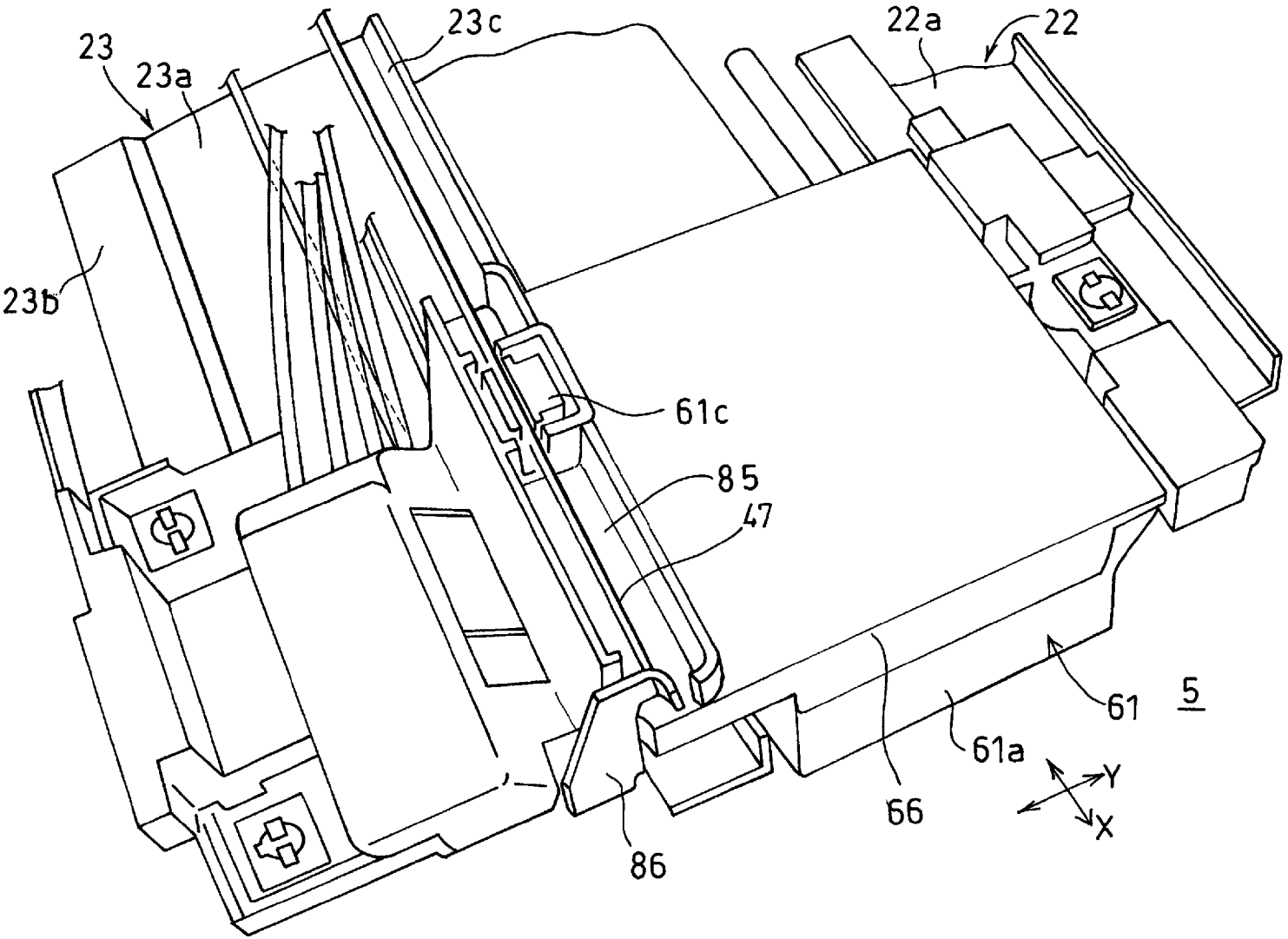
FIG. 7 is an enlarged partly cut-away perspective view of the recording section.
Figure 8:
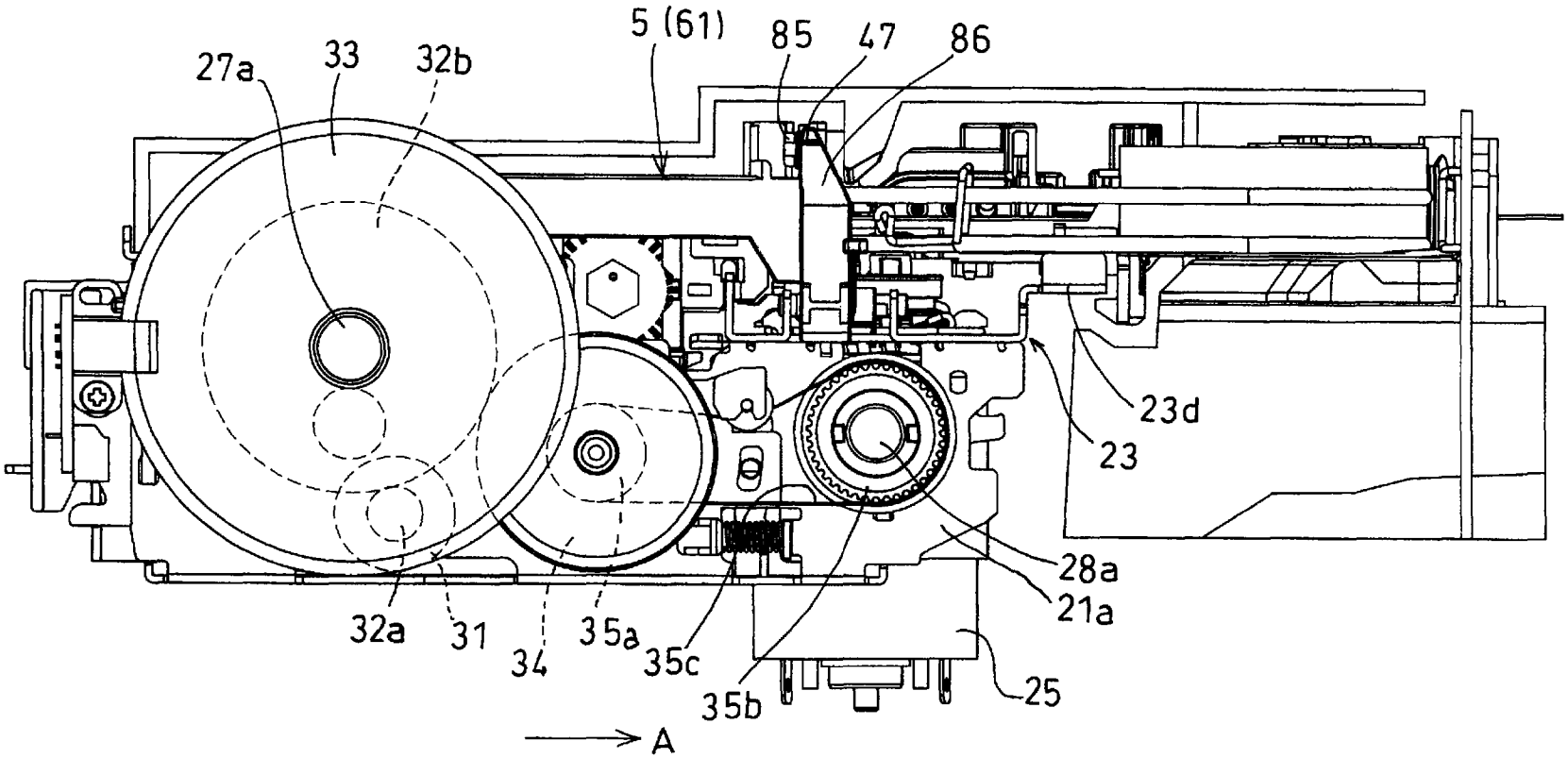
FIG. 8 is an enlarged side view from the VIII-VIII line of FIG. 4.
Figure 9:
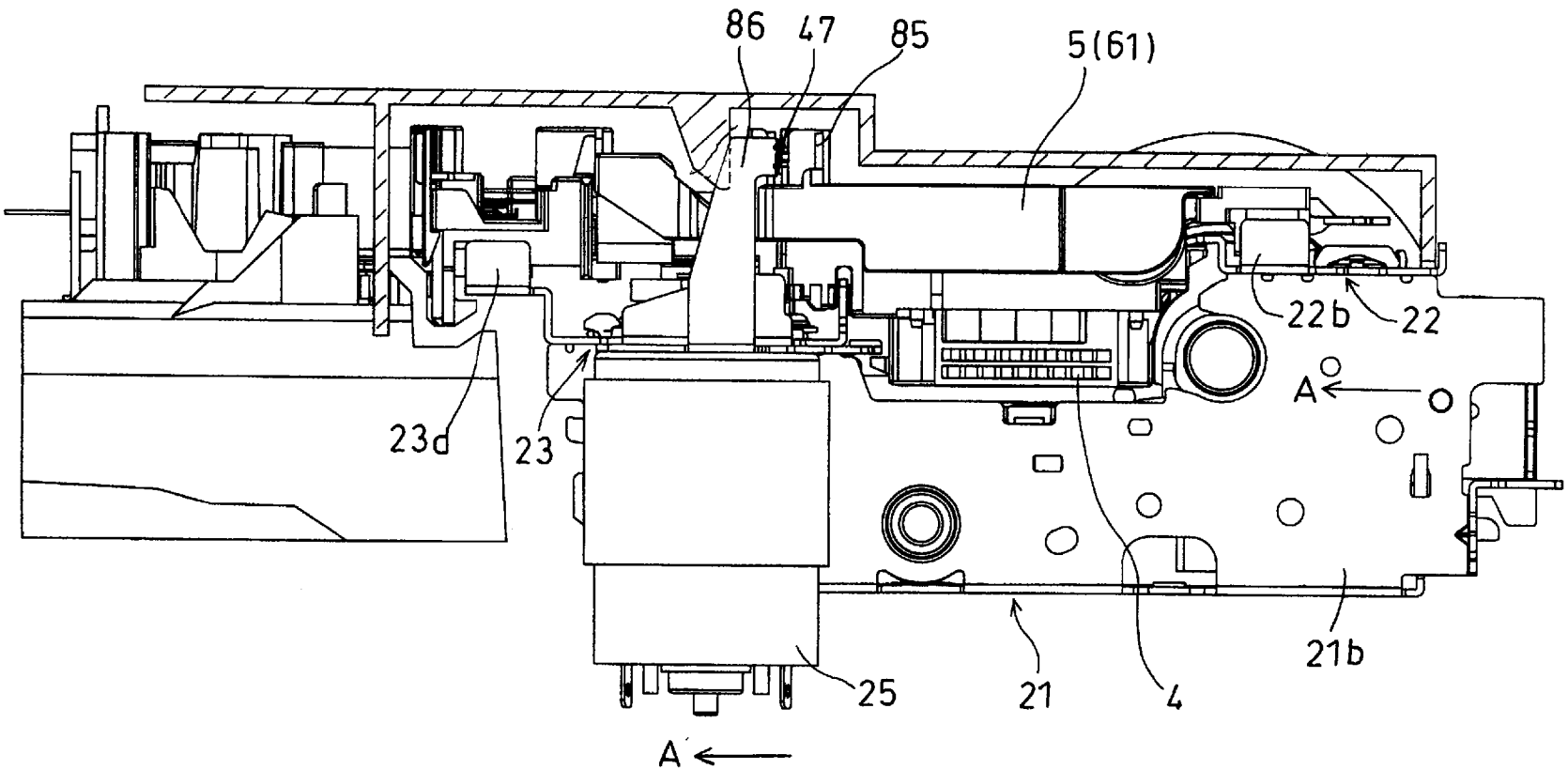
FIG. 9 is an enlarged side sectional view from the IX-IX line of FIG. 4.
Figure 10:
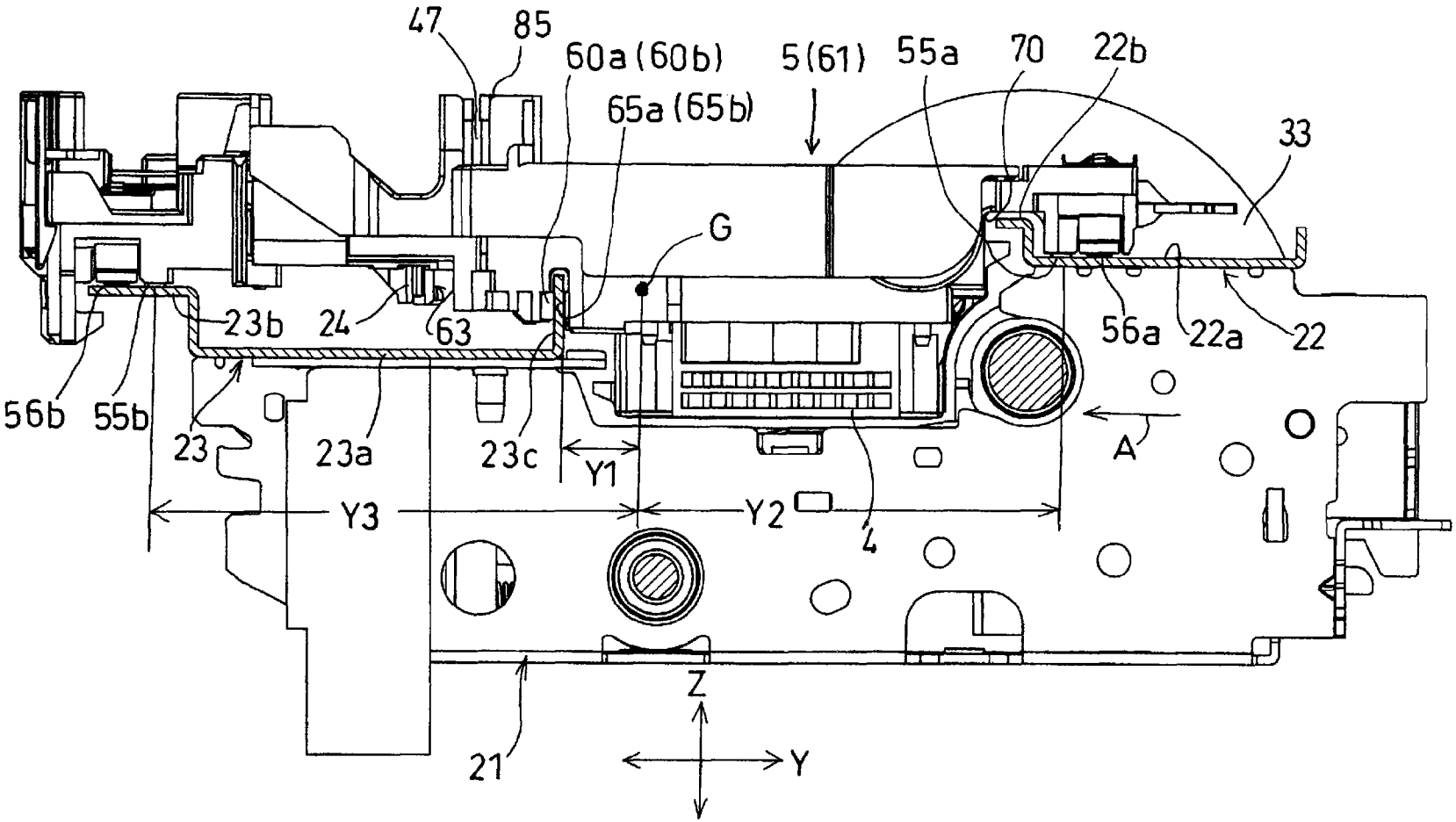
FIG. 10 is an enlarged side sectional view from the X-X line of FIG. 4.
Figure 11:
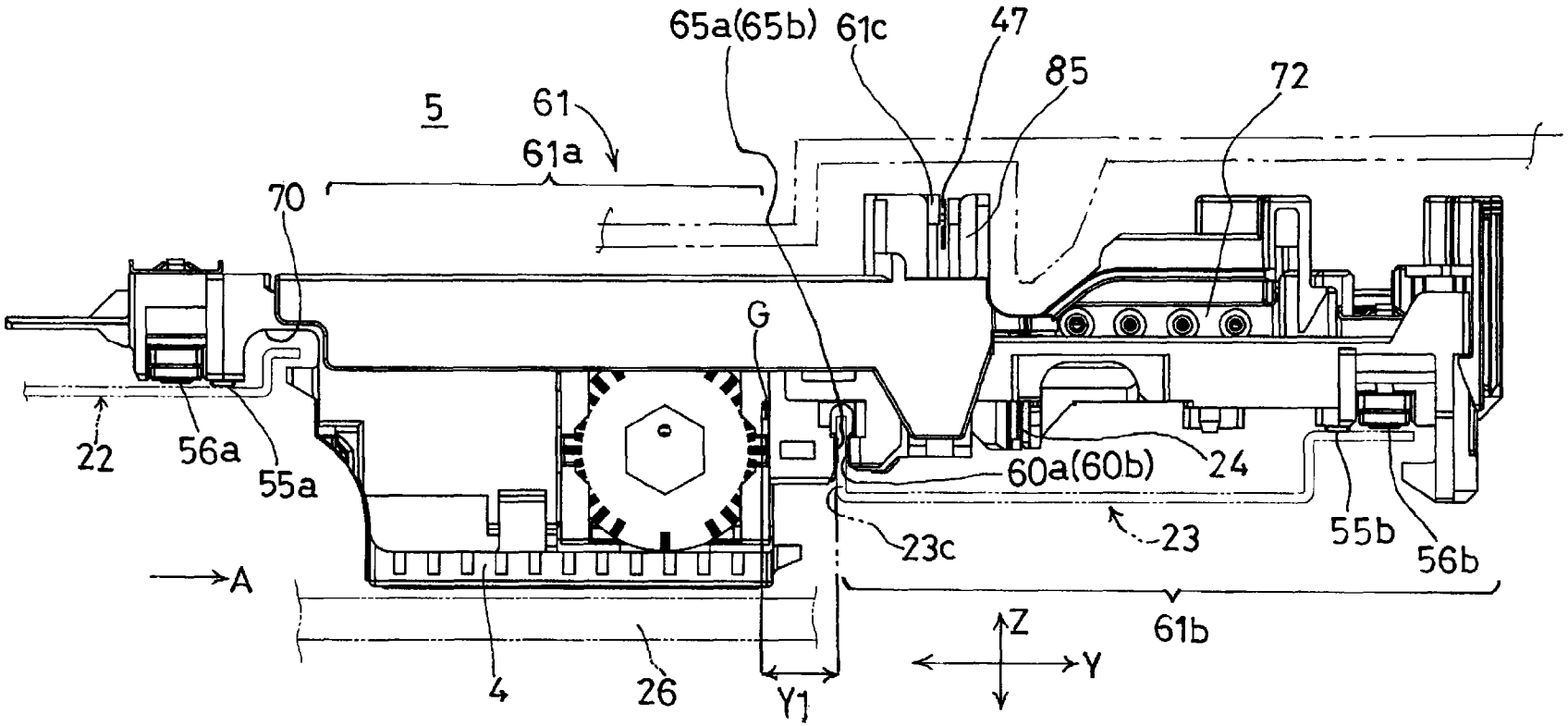
FIG. 11 is a left side view of a carriage.
Figure 12:
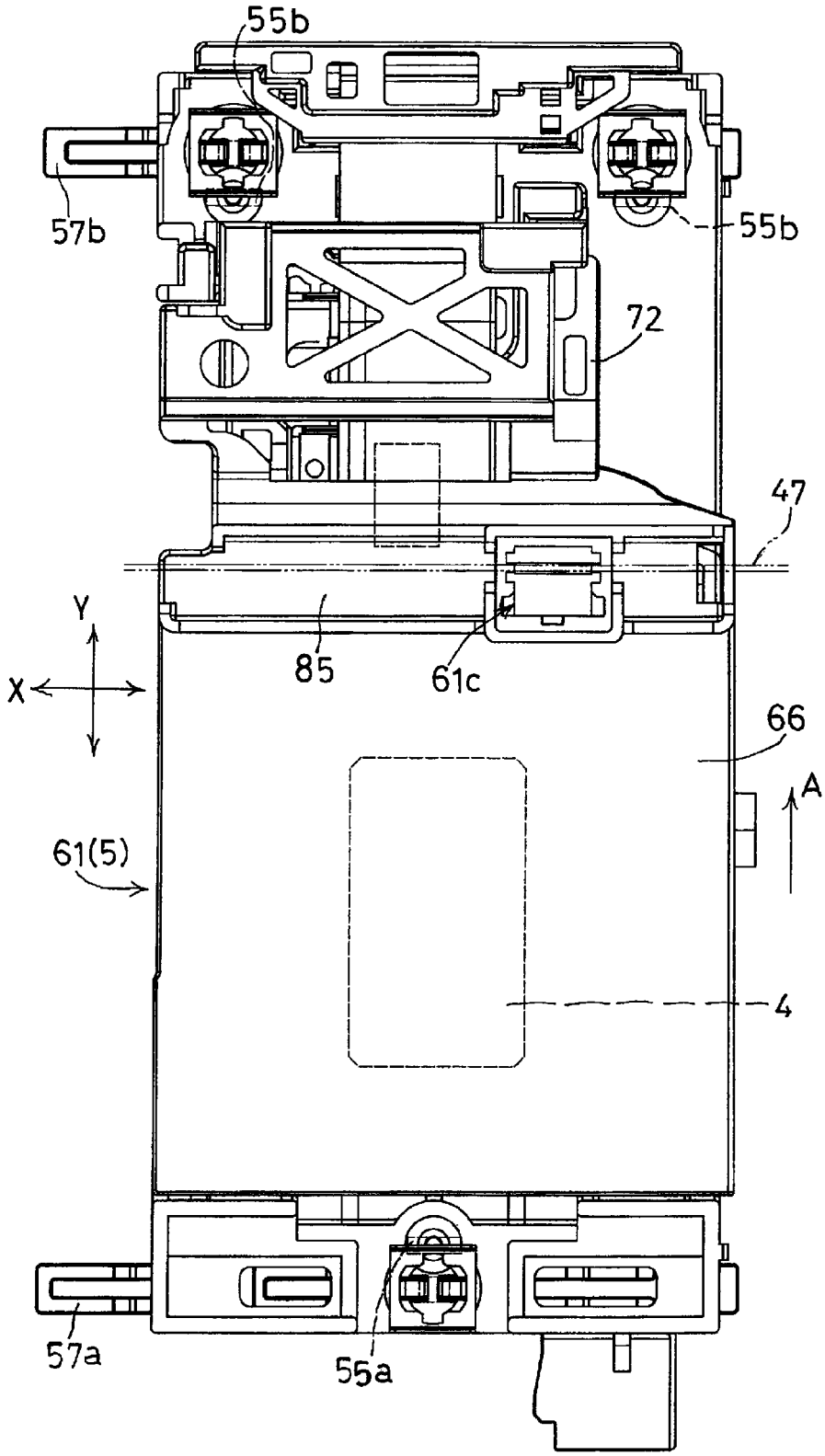
FIG. 12 is a plan view of the carriage.
Figure 13:
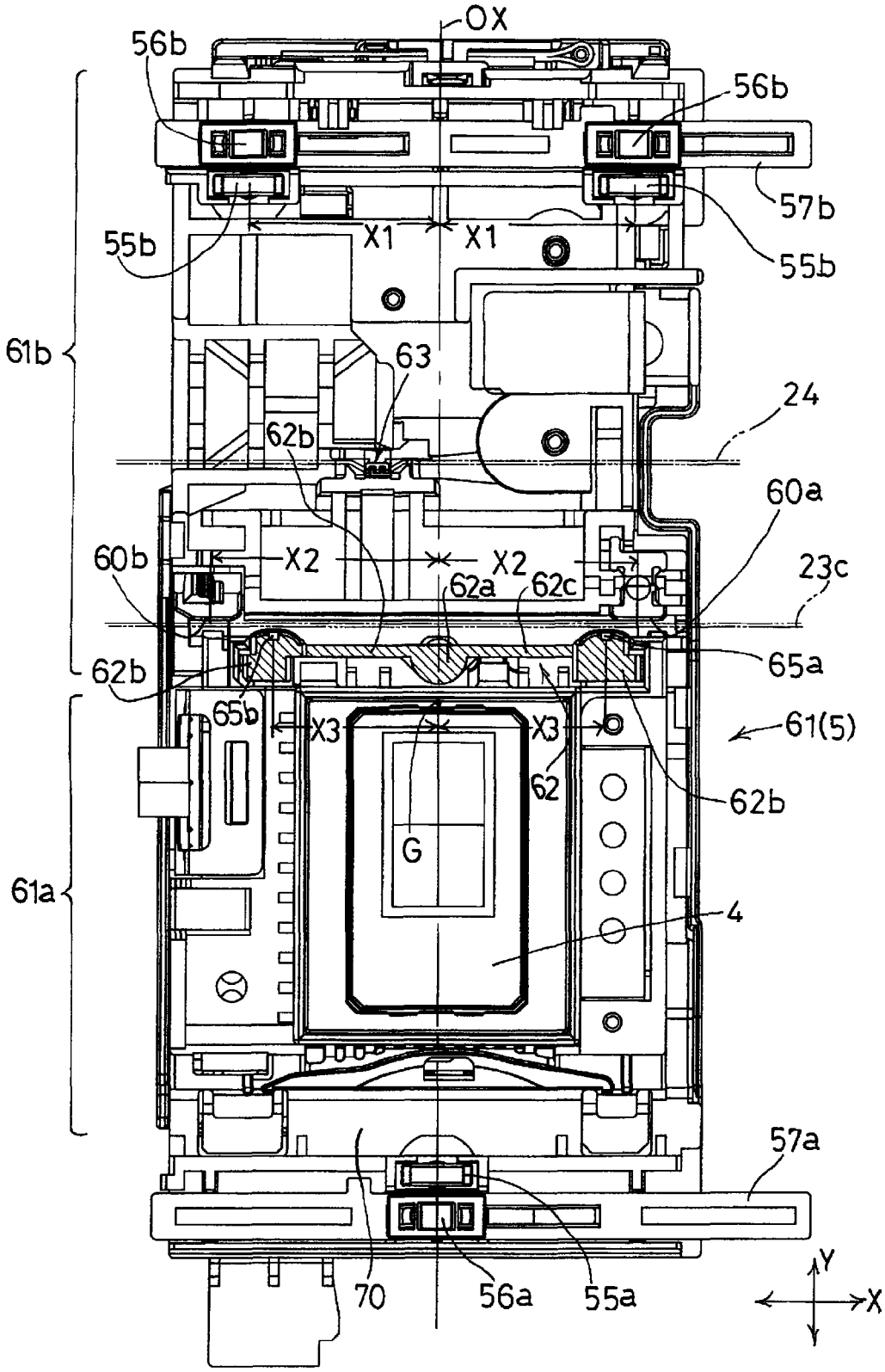
FIG. 13 is a view showing the lower surface of the carriage.
Figure 14:
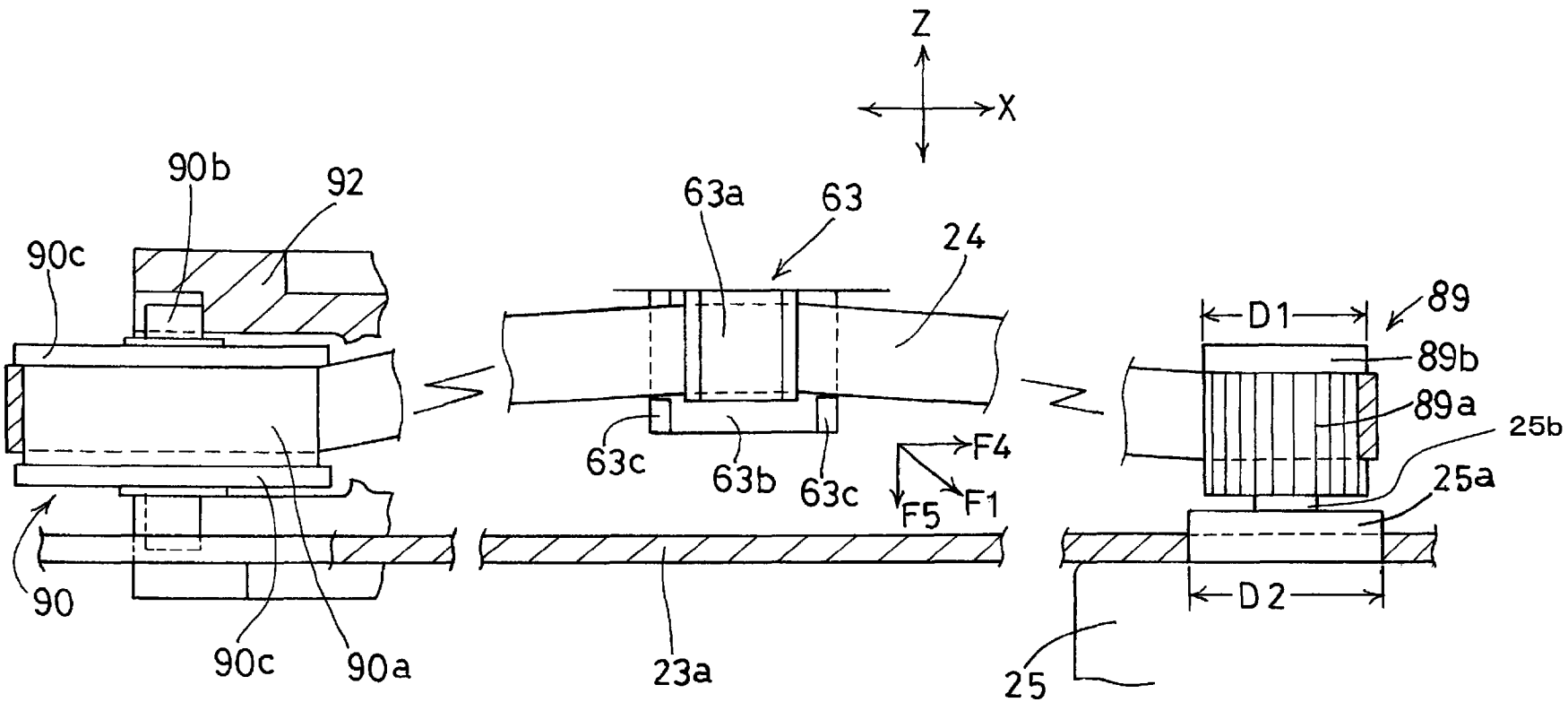
FIG. 14 is a partly cut-away explanatory view showing the joint state of a timing belt.
Figure 15:
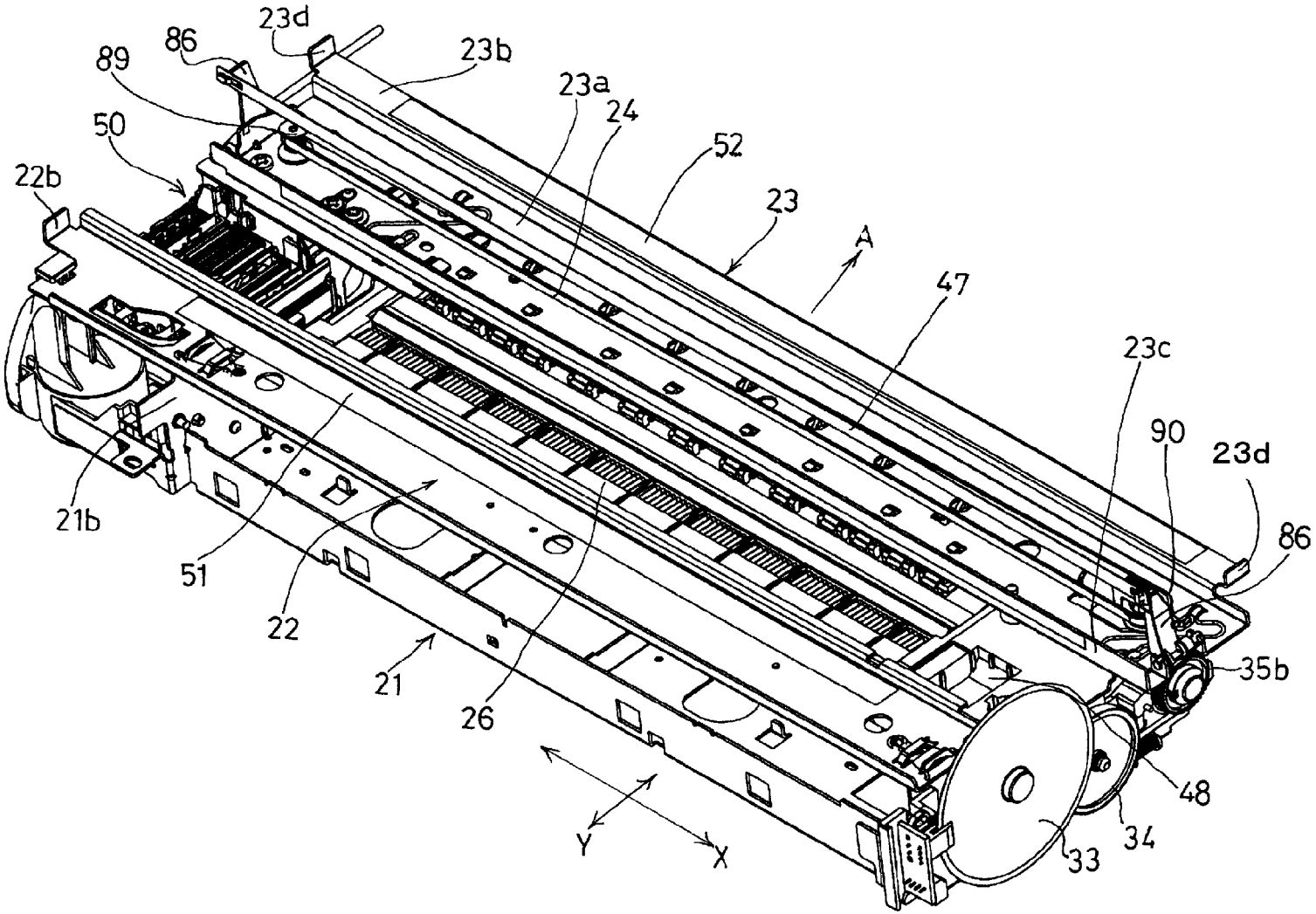
FIG. 15 is a perspective view of the recording section excluding the carriage.

Next, an embodiment will be explained. FIG. 1 is a perspective view of an image recording apparatus according to this embodiment; FIG. 2 is a sectional side view of a recording section and a paper feed cassette; FIG. 3 is a plan view of a recording apparatus main body excluding an image reading device; FIG. 4 is a plan view of the recording section; FIG. 5 is a perspective view of the recording section; FIG. 6 is a view from the VI-VI line of FIG. 4; FIG. 7 is an enlarged partly cut-away perspective view of the recording section; FIG. 8 is an enlarged side view from the VIII-VIII line of FIG. 4; FIG. 9 is a view from the IX-IX line of FIG. 4; FIG. 10 is a side sectional view from the X-X line of FIG. 4 and shows a side surface of a carriage; FIG. 11 is a left side view of the carriage, first support member and second support member; FIG. 12 is a plan view of the carriage; FIG. 13 is a view showing the lower surface of the carriage; FIG. 14 is an explanatory view showing the joint state of an endless belt to the carriage; and FIG. 15 is a perspective view of the recording section excluding the carriage.

An image recording apparatus 1 of this embodiment is applied to a multi function device (MFD) having a printer function, a copy function, a scanner function and a facsimile function. As shown in FIG. 1, placed on the bottom of a recording apparatus main body 2, which is made from a synthetic resin, of the image recording apparatus 1 is a paper feed cassette 3 which is insertable from an opening 2*a* on the front side (the left side in FIG. 1) of the recording apparatus main body 2. The side where the opening 2*a* is formed is referred to as the front side or the front, and the front side, left and right sides and rear side of the apparatus are defined based on this.

In this embodiment, the paper feed cassette 3 is capable of storing paper P cut in a size, such as, for example, A4 size, letter size, legal size and postcard size, as a recording medium in a manner in which a plurality of sheets of stacked paper are placed with the short sides being arranged in a direction (the main scanning direction or the X-axis direction) orthogonal to a paper transport direction (the sub-scanning direction or the Y-axis direction) (see FIG. 1).

An auxiliary cassette 3*a* for stacking and supplying a plurality of sheets of small-sized paper (not shown) is mounted on the upper front side of the paper feed cassette 3 so that it is movable in the Y-axis direction. FIG. 1 shows a state in which the auxiliary cassette 3*a* is pushed into a position where it does not stick out of the recording apparatus main body (housing) 2.

A tilted separation plate 8 for paper separation is provided on the rear side (the right side in FIGS. 1 and 2) of the paper feed cassette 3. Moreover, an arm 6*a* rotatable about an upper end thereof in up and down directions is attached to the recording apparatus main body 2. With a paper feed roller 6 attached to the lower end of the arm 6*a* and the tilted separation plate 8, one sheet of paper is separated at a time from a plurality of sheets of stacked paper on the paper feed cassette 3, or the auxiliary cassette 3*a*, and transported. The separated paper is fed along a paper feed path 9 which has a substantially U shape extending in the up-and-down direction to a recording section 7 provided on the upper rear side (higher position) than the paper feed cassette 3. As will be described in detail later, the recording section 7 comprises a reciprocally movable carriage 5 carrying an inkjet type recording head 4 having a plurality of nozzles for realizing the printer function, etc.

Formed on the upper side of the auxiliary paper feed cassette 3*a* is a paper discharge section 10 in which paper on which recording was performed in the recording section 7 is discharged with the recorded surface facing up. A paper discharge opening 10*a* (above the opening 2*a*) connected to the paper discharge section 10 is open toward the front side of the recording apparatus main body 2.

An image reading device 12 for reading a document with the copy function or the facsimile function is placed in the upper part of the recording apparatus main body 2.

An operation panel section 14 including various kinds of operation buttons and a liquid crystal display section is provided in front of the image reading device 12, on the upper side of the recording apparatus main body 2. The recording section 7, the paper discharge section 10, and an ink storing section 15 provided on one side of the paper discharge section 10 are positioned within the area of the image reading device 12 and operation panel section 14 projected onto a plane.

A glass plate (not shown) which allows a document to be placed thereon by opening a document cover body 13 upward is provided on the upper surface of the image reading device 12, and an image scanner device (CIS: Contact Image Sensor) (not shown) for reading a document is provided under the glass plate so that the CIS is movable reciprocally in the main scanning direction (the X-axis direction in FIG. 1).

The ink storing section 15 is open toward the top of the recording apparatus main body 2. In the ink storing section 15, a plurality of ink cartridges 19, which have almost rectangular box shape with a small area in the plan view and a height and store inks of four colors, respectively, for full color recording, can be stored in one line along the Y-axis direction and detachable from the top (the cartridges of individual colors, namely, black (BK), cyan (C), magenta (M), and yellow (Y), are designated with codes 19*a*-19*d* respectively, see FIG. 3).

This embodiment is constructed so that the inks are supplied from the respective ink cartridges 19 (19*a*-19*d*) to the inkjet type recording head 4 through a plurality of (four in this embodiment) ink supply tubes 20 (indicated individually as 20*a*-20*d*, see FIGS. 4 and 5). In the case of using more than four color inks (six to eight color inks, for example), it may be possible to construct the ink storing section 15 to store the ink cartridges corresponding to the number of colors of inks, and the ink supply tubes 20 may also be increased according to the number of the ink cartridges.

As shown in FIGS. 3 to 15, the recording section 7 is supported by one pair of side plates 21*a* and 21*b* of a main frame 21 in the form of a frame with an open top. The recording section 7 comprises a first support member 22 and a second support member 23 in the form of a horizontally long plate extending in the X-axis direction (main scanning direction); a carriage 5 which is slidably supported (carried) and reciprocally movable over the two support members 22 and 23 and carries the recording head 4; a timing belt 24 as an endless belt placed on the upper surface of the second support member 23 parallel to the second support member 23 to reciprocally move the carriage 5; a carriage motor (CR motor) 25 for driving the timing belt 24 (Although a DC motor is used in this embodiment, other motor such as a stepping motor may be used.); a plate-like platen 26 for supporting the transported paper under the recording head 4; and an encoder strip 47 in the form of a band placed along the main scanning direction for detecting the position of the carriage 5 in the X-axis direction (main scanning direction) and the moving speed in the same direction. The encoder strip 47 is arranged so that an inspection surface (a surface where slits are formed at fixed intervals in the X-axis direction) is placed along a vertical direction. Note that the first support member 22 is placed on the upstream side of the platen 26 in the transport direction of paper (the direction of arrow A, see FIGS. 3, 4 and 9-11), and the second support member 23 is placed on the downstream side.

Moreover, as shown in FIGS. 12 and 13 and will be described later, on the lower surface of the carriage 5 (holder body 61), one first leg section 55*a* and one pair of second leg sections 55*b* are provided to protrude from the lower surface. The one first leg section 55*a* and one pair of second leg sections 55*b* are arranged to form the vertexes of a triangle over the first support member 22 and second support member 23. The first leg section 55*a* comes into contact with a first slide surface 51 of the first support member 22, and the one pair of second leg sections 55*b* comes into contact with a second slide surface 52 of the second support member 23. Further, the first leg section 55*a* is located at the center in the X-axis direction of the holder body 61. The one pair of second leg sections 55*b* is symmetrically arranged about a center line OX in the X-axis direction of the holder body 61 at a distance of suitable dimension X1 from the center line OX (see FIG. 13). Therefore, in the plan view (or the lower surface view) of the carriage 5, a shape formed by connecting the respective center points of the one first leg section 55*a* and one pair of left and right second leg sections 55*b* is an isosceles triangle. With this structure, the carriage 5 is stably supported with respect to the first and second support members 22 and 23.

On the other hand, the lower surfaces of the first support member 22 and second support member 23 extending along the main scanning direction (X-axis direction) are joined with one pair of side plates 21*a* and 21*b* extending in the sub-scanning direction (Y-axis direction). In order to increase as large as possible the movable range in the X-axis direction and consequently the recordable area of paper in the X-axis direction while increasing the interval (2X1) of the one pair of second leg sections 55*b* in the X-axis direction, at least one side of the second support member 23, and preferably both sides (in this embodiment, the left and right sides shown in FIGS. 4 and 5) are extended to the outside of the side plates 21*a* and 21*b* along the X-axis direction. Therefore, in the state in which the carriage 5 is positioned at the left end (namely, a later-described ink receiving section 48) of the recording section 7, the left second leg section 55*b* of the carriage 5 can be positioned on the left end of the second support member 23 beyond the left side plate 21*a*.

Moreover, one pair of resist rollers 27 is provided on the upstream side of the platen 26 in the transport direction to send the paper to the space between the platen 26 and the nozzle surface where the nozzles are formed on the lower surface of the recording head 4. A spur 28*b* that comes into contact with the upper surface of the paper, and a discharge roller 28*a* that comes into contact with the lower surface thereof are provided on the downstream side of the platen 26 in the transport direction to transport the recorded paper to the paper discharge section 10.

Further, as described above, in order to decrease the width dimension of the recording apparatus main body 2 while increasing the movable range of the carriage 5 in the X-axis direction, the positions of component parts to be placed on one side or both sides of the main frame 21 in the X-axis direction are adjusted. In this embodiment, as shown in FIGS. 4 to 6 and 8, the drive shaft (not shown) of a drive motor 31 for paper transport is fixed to the inner surface of the left side plate 21*a* and protrudes from the external surface of the left side plate 21*a*. Power is transmitted from a pinion gear 32*a* attached to this drive shaft to a first gear 32*b* coaxially and directly connected to a drive roller 27*a* of the resist rollers 27. A large-diameter rotary encoder detection disk 33 is provided on the drive roller 27*a*, and the top of the rotary encoder detection disk 33 protrudes upward from the upper surface of the left side plate 21*a*. An endless timing belt 35*c* is wound around a first pulley 35*a*, which is coaxially and directly connected to an intermediate gear 34 meshing with the first gear 32*b*, and a second pulley 35*b* attached to a paper discharge roller 28*a*. Moreover, the diameter of the second pulley 35*b* is made smaller compared to a conventional pulley so that the second pulley 35*b* is stored in the space between the external surface of the left side plate 21*a* and the lower surface of the second support member 23 and that the dimension in the left-to-right direction of the overall recording section 7 is decreased.

Outside the width of paper (short side of paper) to be transported, the ink receiving section 48 is provided on one end (in this embodiment, a position near the left side plate 21*a* in FIGS. 3 and 4) of the recording apparatus main body 2, and a maintenance unit 50 is provided on the other end (a position near the right side plate 21*b* in FIG. 3). Thus, the recording head 4 periodically performs ink ejection for preventing clogging of the nozzles during a recording operation at a flushing position located in the ink receiving section 48, and receives the ink in the ink receiving section 48. The maintenance unit 50 is placed at a standby position of the carriage 5, and performs a process of selectively sucking ink of each color, and a recovery process for removing bubbles in a buffer tank, not shown, on the recording head 4. Further, the maintenance unit 50 has a wiper, not shown, and cleans the nozzle surface of the recording head 4 when moving the carriage 5 from the maintenance unit 50 to the direction of an image recording area.

The first support member 22 on the upstream side of the paper transport direction (the direction of arrow A) and the second support member 23 on the downstream side are arranged substantially horizontally. In the first support member 22, as shown in FIGS. 9 to 11 illustrating the side section of the first support member 22, a flat plate section 22*a* and a projection piece 22*b* are integrally formed. The flat plate section 22*a* has the first slide surface 51 for supporting the upstream part of the carriage 5 in the transport direction to be horizontally slidable, and the projection piece 22*b* has a Z-shaped side surface fitted in a fitting recess section 70 on the upstream side of the later-described holder body 61 of the carriage 5 in the transport direction.

As shown in FIGS. 4 to 6, 9 to 11 and 15, the second support member 23 comprises a horizontal wide piece 23*a* for use as a reference surface in the vertical direction (Z-axis direction) in mounting the timing belt 24, CR motor 25, encoder strip 47 etc.; a flat plate section 23*b* having the second slide surface 52 for supporting the downstream part of the carriage 5 in the transport direction to be horizontally sidable at a position on the downstream side of the horizontal wide piece 23*a* in the transport direction; and a substantially vertical contact piece 23*c* which is bent upward at a position on the upstream side of the horizontal wide piece 23*a* in the transport direction.

The first slide surface 51 of the first support member 22 and the second slide surface 52 of the second support member 23 are formed on the upper surfaces of the support members 22 and 23, respectively, so that they are parallel to the lower surface (nozzle surface) of the recording head 4. Formed on the contact piece 23*c* is a third slide surface 54 facing the downstream side in the transport direction (see FIGS. 4 and 5). The first, second, and third slide surfaces 51, 52 and 54 are linearly long in the X-axis direction.

As shown in FIGS. 11 to 13, the carriage 5 comprises the holder body 61 made of a synthetic resin having a substantially rectangular shape in the plan view. Formed on the upstream side of the holder body 61 in the transport direction is a head storing section 61*a* having a height dimension capable of storing the recording head 4 on the lower side of the carriage 5. On the downstream side of the holder body 61 in the transport direction, there are integrally formed an ink channel (not shown) for supplying ink to the recording head 4 by connecting an end of each of the ink supply tubes 20*a*-20*d* in the left-and-right direction, a connection support section 61*b* for connecting an end of the flexible flat cable 40, and a guide groove 85 for a light transmitting type sensor (photocoupler) 61*c* to allow passage of the encoder strip 47 and detect the position and moving speed of the carriage 5.

A first auxiliary leg section 56*a* provided adjacent to the first leg section 55*a* is constructed so that it selectively protrudes more in a downward direction compared to the lower surface of the first leg section 55*a* when the gap (paper gap) between the nozzle surface of the recording head 4 and the platen 26 is made larger than that in making contact with the first leg section 55*a*. Similarly, one pair of second auxiliary leg sections 56*b* provided adjacent to the one pair of second leg sections 55*b* are constructed so that they selectively protrude more in a downward direction compared to the lower surface of the second leg sections 55*b* when the gap between the nozzle surface of the recording head 4 and the platen 26 is increased (see FIGS. 10, 11 and 13). Note that the carriage 5 has a mechanism (not shown) for selectively raising or lowering the first auxiliary leg section 56*a* and the second auxiliary leg sections 56*b* (detailed explanation is omitted); and function pieces 57*a* and 57*b* that can move reciprocally in the X-axis direction and can appear and disappear. At the time the carriage 5 is moved along the X-axis direction, when the function pieces 57*a* and 57*b* hit projection pieces 22*b* and 23*d* of the first support member 22 and second support member 23 at one end and the other end, the first auxiliary leg section 56*a* and the second auxiliary leg sections 56*b* are selectively raised or lowered (see FIGS. 4, 5, 8, 9, 10 and 13).

In the carriage 5 (holder body 61), one pair of first slidable projection sections 60*a* and 60*b* that comes into contact with the third slide surface 54 on the second support member 23 are integrally formed. In other words, in FIG. 13, the one pair of first slidable projection sections 60*a* and 60*b* is arranged symmetrically about the center line OX in the X-axis direction at a distance of suitable dimension X2 from the center line OX.

Further, in the carriage 5 (holder body 61), one pair of second slidable projection sections 65*a* and 65*b* is arranged on the side facing the first slidable projections 60*a* and 60*b* with the contact piece 23*c* therebetween. This one pair of second slidable projection sections 6Sa and 65*b* is formed on both ends of a clamping body 62 (see the part shadowed with lines in FIG. 13) that is a resilient member made of a synthetic resin and extending in the left-and-right direction. As shown in FIG. 13, one pair of second slidable projection sections 65*a* and 65*b* is arranged symmetrically about the center line OX in the X-axis direction at a distance of a suitable dimension X3 (<X2<X1) from the center line OX.

As shown in FIG. 13, the center section in the left-and-right direction of the clamping body 62 is an attachment section 62*a* with respect to the holder body 61, and the portion between the attachment section 62*a* and expanded sections 62*b* on both ends in the left-and-right direction is a joint section 62*c* having flexibility by itself and a smaller cross section compared with the attachment section 62*a* and the expanded portions 62*b*. In each of the expanded sections 62*b*, a compression coil spring, not shown, is placed. With energizing forces of the compression coil springs, the contact piece 23*c* is clamped and resiliently supported by the clamping body 62 and the first slidable projection sections 60*a* and 60*b*. Note that the space between the clamping body 62 and the first slidable projection sections 60*a* and 60*b* is open in the main scanning direction (X-axis direction) and a downward direction (Z-axis direction) (see FIGS. 10, 11 and 13).

On the lower surface of the carriage 5, a belt joint section 63 (joint section) to which a part of the timing belt 24 is joined is provided between the second leg sections 55*b* and the first slidable projection section 60*a* (60*b*) in the sub-scanning direction (Y-axis direction) (see FIGS. 10 and 13). More specifically, the belt joint section 63 is provided on the lower surface of the connection support section 61*b*, and has a groove section which is open to the lower side of the carriage 5 and both sides in the main scanning direction so that the timing belt 24 is fitted into the groove section.

As shown in FIGS. 3, 4, 5 and 14 (though only the driven pulley 90 is shown in FIGS. 4 and 5), a drive pulley 89 and a driven pulley 90 on which the timing belt 24 is to be wound are arranged on the upper surface of the horizontal wide piece 23*a* of the second support member 23 at both ends in the main scanning direction. With this arrangement, the second support member 23 can perform both the function of slidably supporting the carriage 5 and the function of mounting moving means such as the drive pulley 89, CR motor 25, and driven pulley 90. Thus, this arrangement enables a decrease in the costs, and also produces the advantageous effect of reducing the sizes of the recording section 7 and consequently the image recording apparatus 1.

A maximum diameter D1 of the drive pulley 89 fitted on a drive shaft 25*b* protruding from a neck section 25*a* of the CR motor 25 is made smaller than a diameter D2 of the neck section 25*a* (see FIG. 14). In a state in which the drive pulley 89 is installed and fixed on the drive shaft 25*b* beforehand, the drive pulley 89 and the neck section 25*a* are inserted from a lower direction into a mount hole (with a diameter equal to the diameter D2 of the neck section 25*a*) formed in the horizontal wide piece 23*a* of the second support member 23. Next, the CR motor 25 is fixed by fastening a screw (not shown) from the upper surface of the horizontal wide piece 23*a*.

Thus, by arranging the maximum diameter D1 of the drive pulley 89 to be smaller than the diameter D2 of the neck section 25*a* of the CR motor 25 and forming the mount hole substantially equal to the diameter D2 of the neck section 25*a* in the second support member 23, it is possible to fit the drive pulley 89 on the drive shaft 25*b* before mounting the CR motor 25 on the second support member 23. Moreover, in the horizontal wide piece 23*a* of the second support member 23, since it is only necessary to form the mount hole for mounting the CR motor 25, the mechanical strength of the second support member 23 is not decreased to an extreme degree. Further, it is possible to place the drive pulley 89 extremely close to the neck section 25*a* compared with a mount structure in which the horizontal wide piece 23*a* is positioned between the neck section 25*a* and the drive pulley 89. If a tooth flank (tooth profile) 89*a* for the timing belt 24 is formed on the circumferential surface of the drive pulley 89, a slip phenomenon will not occur between the rotation of the CR motor 25 and the movement of the timing belt 24. In addition, on the top end of the drive pulley 89, a flange section 89*b* for preventing disengagement of the timing belt 24 is integrally formed.

The driven pulley 90 comprises a pulley section 90*a* around which the timing belt 24 is to be wound, a shaft section 90*b* protruding from the pulley section 90*a* in both directions along the line of the rotation center axis, and a large-diameter flange section 90*c* for preventing the both edges in the width direction of the timing belt 24 from being disengaged toward the shaft section 90*b*, which are integrally formed from a synthetic resin material (see FIG. 14). A holder 92 supporting the driven pulley 90 rotatably is resiliently energized by a spring (not shown) in the direction of separating from the drive pulley 89.

If the positions of the drive pulley 89 and driven pulley 90 are biased so that a portion of the timing belt 24, which is wound around the drive pulley 89 and driven pulley 90, joined to the carriage 5 is substantially parallel to the contact piece 23*c* of the second support member 23 and that a minimum distance from the axial center (rotation center) of the drive pulley 89 to the contact piece 23*c* is smaller than a minimum distance from the axial center (rotation center) of the driven pulley 90 to the contact piece 23*c*, then, when the carriage 5 moves in the main scanning direction (X-axis direction), the timing belt 24 can tug the carriage 5 parallel to the contact piece 23*c*, and therefore the carriage 5 can move stably along the third slide surface 54 (reference surface) of the contact piece 23*c*, and the image recording performance can be improved. In this case, by placing the large-diameter driven pulley 90 apart from the contact piece 23*c*, it is possible to decrease the width dimension of the second support member 23 in the direction of arrow A and reduce the size.

Moreover, it is preferred to position the drive pulley 89, the driven pulley 90 and the belt joint section 63 of the carriage 5 to timing belt 24 so that a component of force (component force) of tension of the timing belt 24 on the side where the carriage 5 is attached acts in the direction of pushing the carriage 5 against both the flat plate section 23*b* and contact piece 23*c* of the second support member 23. Consequently, the movement of the carriage 5 is stabilized as described later.

Thus, in order to push the carriage 5 against the contact piece 23*c* of the second support member 23, the minimum distance between the belt joint section 63 of the carriage 5 and the third slide surface 54 of the contact piece 23*c* is set larger than the minimum distance between the third slid surface 54 and a portion of the drive pulley 89 and the driven pulley 90 where the timing belt 24 is wound. In this structure, among the component forces of tension F with respect to the timing belt 24 in the belt joint section 63, a component force in the Y-axis direction orthogonal to the X-axis direction in which the contact piece 23*c* extends pushes the carriage 5 against the third slide surface 54 located on the side where the timing belt 24 is placed, thereby stabilizing the posture of the carriage 5 during movement and improving the image recording performance.

On the other hand, FIG. 14 shows an embodiment in which the carriage 5 is pushed and energized toward the second slide surface 52 on the upper surface of the horizontal wide piece 23*a* of the second support member 23. The height position of the belt joint section 63 of the carriage 5 to the timing belt 24 is biased upward compared to the height position where the timing belt 24 is wound around the drive pulley 89 and driven pulley 90. In this case, in the belt joint section 63, the lower edge of the timing belt 24 fitted and held between blocks 63*a* and 63*b* engages with one pair of engagement claw sections 63*c* protruding from both ends of the lower edge of the block 63*b* to prevent the timing belt 24 from dropping down. Further, the upper edge of the timing belt 24 is controlled by the flange section 89*b* at the top end of the drive pulley 89 to prevent the timing belt 24 from being disengaged in an upward direction, and the upper edge of the timing belt 24 is also controlled by the upper flange section 90*c* at the top of the driven pulley 90 to prevent the timing belt 24 from being disengaged in an upward direction.

In this embodiment, the position of center of gravity G of the entire carriage 5 with respect to the X-axis direction (the left-to-right width direction of the carriage 5) is on the center line OX in the X-axis direction shown in FIG. 13. With respect to the Y-axis direction, as shown in FIGS. 10 and 11, it is on a position in the head storing section 61*a* of the carriage 5 where the distance Y1 from the second slidable projection sections 65*a* and 65*b* along the Y-axis is short. Moreover, the height position of the position of center of gravity G of the entire carriage 5 with respect to the Z-axis direction (vertical direction) is at substantially the same as the height position of the belt joint section 63 in the Z-axis direction (vertical direction). More specifically, the height position of the position of center of gravity G is within the width of the timing belt 24 (see FIGS. 10 and 11). In this structure, even when the carriage 5 starts moving in the main scanning direction (even when the carriage 5 receives the influence of acceleration), moment about the Y-axis through the position of center of gravity G of the carriage 5 can be supported by the second leg sections 55*b* (second slide surface 52). As a result, it is possible to ensure stable movement of the carriage 5 in the main scanning direction with respect to the rotational moment of the carriage 5 about the Y-axis through the position of center of gravity G.

As shown in FIGS. 4, 12 and 13, the carriage 5 is supported in a triangular shape in the plan view by one first leg section 55*a* and one pair of second leg sections 55*b* and 55*b* of the carriage 5 with respect to the first support member 22 (first slide surface 51) and the second support member (second slide surface 52), and the interval X1 of placing one pair of the second leg sections 55*b* and 55*b* in the X-axis direction is large. Therefore, the posture of the carriage about the Y-axis through the position of center of gravity G of the carriage 5 is stabilized. In particular, a force trying to rotate the carriage 5 about the Y-axis with the function of component force F4 in the X-axis direction caused by the timing belt 24 when the carriage 5 starts moving in the main scanning direction (X-axis direction) (or when the carriage moves from a stationary state by receiving acceleration) can be efficiently received by the second slide surface 52 and one pair of second leg sections 55*b* and 55*b* spaced from each other in the left-and-right direction. As a result, it is possible to prevent a change in the posture of the carriage 5 about the Y-axis, and it is possible to ensure stable movement of the carriage 5 in the main scanning direction.

In this embodiment, among the component force F4 in the X-axis direction and component force F5 in the Z-axis direction of tension F1 with respect to the timing belt 24 in the belt joint section 63, the component force F5 in the Z-axis direction and the self weight of the carriage 5 act in a downward direction on the first slide surface 51 of the first support member 22 and the second slide surface 52 of the second support member 23 through the first leg section 55*a* and the second leg sections 55*b*. Moreover, as shown in FIG. 10, the distance Y2 from the position of center of gravity G of the carriage 5 to the first leg section 55*a* along the Y-axis and similarly the distance Y3 to the second leg sections 55*b* are large. Therefore, even when the carriage 5 is in a stationary state or even when the carriage 5 is moved in the X-axis direction (main scanning direction) at a fixed speed, the carriage 5 can be stably supported by the first support member 22 and second support member 23 through the first leg section 55*a* and the second leg sections 55*b* which are largely spaced from each other along the Y-axis. Consequently, the gap between the lower surface of the recording head 4 carried on the carriage 5 and the paper on the platen 26 is stabilized, thereby improving the image recording performance.

The contact piece 23*c* of the second support member 23 has the third slide surface 54 which stands substantially orthogonal to the second slide surface 52 at a position between the first slide surface 51 and the second slide surface 52 in the Y-axis direction. The carriage 5 comprises the one pair of first slidable projection sections 60*a* and 60*b* that is slidable in contact with the third slide surface 54; the one pair of second sidable projections sections 65*a* and 65*b* facing the first slidable projection sections 60*a* and 60*b* with the third slide surface 54 (contact piece 23*c*) therebetween; and the clamping body 62 for resiliently energizing the second slidable projection sections 65*a* and 65*b* toward the third slidable surface 54. The belt joint section 63 is positioned between the second leg sections 55*b* and the first sidable projection sections 60*a* and 60*b* along the Y-axis. In this structure, since the first sidable projection sections 60*a* and 60*b* of the carriage 5 come into contact with the third slide surface 54, it is possible to receive rotational moment trying to rotate the carriage 5 about the Z-axis due to the tension of the timing belt 24, thereby preventing a change in the posture of the carriage 5 about the Z-axis and ensuring stable movement of the carriage 5 in the main scanning direction (X-axis direction).

If the height position of the belt joint section 63 is set at a higher position than the mount section (the drive pulley 89 and driven pulley 90) of the timing belt 24 with respect to the second support member 23, the component force F5 in the vertical direction of the tension of the timing belt 24 acts on the carriage 5 at the position of the belt joint section 63 of the carriage 5 particularly when the carriage 5 starts moving in the main scanning direction (when the carriage 5 moves from a stationary state by receiving acceleration). In this case, rotational moment trying to rotate the carriage 5 about the X-axis through the belt joint section 63 due to the component force can be efficiently received by the second leg sections 55*b* (second slide surface 52) and the first slidable projection sections 60*a* and 60*b* (third slidable surface 54). As a result, it is possible to prevent a change in the posture of the carriage 5 about the X-axis through the belt joint section 63, and it is possible to ensure stable movement of the carriage 5 in the main scanning direction.

A plurality of flexible ink supply tubes 20*a*-20*d* for supplying the inks from the ink storing section 15 provided at a stationary position of the recording apparatus main body 2 are connected to one side (the connection support section 61*b*) of the carriage 5 in the Y-axis direction. When the connection position (tube connection section 72) of the ink supply tubes 20*a*-20*d* and the carriage is located between the first leg section 55*a* and the second leg sections 55*b* in the Y-axis direction, a load in the vertical (Z-axis) direction is applied to the connection support section 61*b*. Moment about the X-axis through the position of center of gravity G of the carriage 5 caused by the load can also be supported by the second leg sections 55*b* (second slide surface 52). As a result, it is possible to prevent a change in the posture of the carriage 5 about the X-axis through the position of center of gravity G, and it is possible to ensure stable movement of the carriage 5 in the main scanning direction.

Moreover, since a position where the flexible ink supply tubes 20*a*-20*d* are connected to one side (the connection support section 61*b*) in the sub-scanning direction of the carriage 5 is located between the belt connection section 63 and the second slidable surface 52 in the sub-scanning direction, the position where the connected ink supply tubes 20*a*-20*d* are curved with the movement of the carriage 5 changes, and consequently the rotational moment about the Z-axis acts on the carriage 5. However, since the carriage 5 slides with one pair of first slidable projection sections 60*a* and 60*b* on the third slide surface 54, it is possible to effectively receive the rotational moment about the Z-axis. As a result, it is possible to ensure stable movement of the carriage 5 in the main scanning direction.

In the Y-axis direction, the tube connection section 72 where the ink supply tubes 20*a*-20*d* and the carriage are connected is located between the second leg sections 55*b* and the first slidable projection sections 60*a* and 60*b*. In other words, since the tube connection section 72 is located in the first slidable projection sections 60*a* and 60*b* near the belt joint section 63, moment about the X-axis through the position of center of gravity G of the carriage 5 caused by a load when the ink supply tubes 20*a*-20*d* are connected can also be supported by the second leg sections 55*b* (second slide surface 52) and the first slidable projection sections 60*a* and 60*b* (third slide surface 54). As a result, it is possible to prevent a change in the posture of the carriage 5 about the X-axis, and it is possible to ensure stable movement of the carriage 5 in the main scanning direction.

Further, the position of the belt joint section 63 in the carriage 5 along the Y-axis is also located between the first leg section 55*a* (first slide surface 51) and the second leg sections 55*b* (second slide surface 52). Therefore, a force trying to rotate the carriage 5 about the X-axis through the belt joint section 63 with the function of the component force F5 in the Z-axis direction caused by the timing belt 24 particularly when the carriage 5 starts moving in the main scanning direction (X-axis direction) (when the carriage moves from a stationary state by receiving acceleration) can be efficiently received by the first leg sections 55*a* (first slide surface 51) and the second leg sections 55*b* (second slide surface 52). As a result, it is possible to prevent a change in the posture of the carriage 5 about the X-axis, and it is possible to ensure stable movement of the carriage 5 in the main scanning direction.

The planar shape (projected shape) of the carriage 5 on a plane including the X-axis and the Y-axis is substantially symmetrical in the X-axis direction (in other words, symmetrical about the Y-axis line including the position of center of gravity G), and the position of center of gravity G of the carriage 5 on the plane including the X-axis and Y-axis is close to the third slide surface 54. It is therefore possible to decrease rotational moment about the Z-axis through the position of center of gravity G with respect to the third slide surface 54, and the posture of the carriage 5 is stabilized against the rotational moment about the Z-axis. In addition, it is also possible to decrease the energizing force of the resilient member for resiliently energizing one pair of second slidable projection sections 65*a* and 65*b* with respect to the third slide surface 54.

Further, since the belt joint section 63 of the timing belt 24 and the carriage 5 is positioned between the second slide surface 52 and the third slide surface 54 in the Y-axis direction, the slide resistance during the movement of the carriage 5 with respect to the third slide surface 54 is reduced, and it is possible to decrease the tensile force of the timing belt 24 and reduce the size of the CR motor 25.

Additionally, as shown in FIG. 13, one pair of first sidable projection sections 60*a* and 60*b* of the carriage 5 comes into contact with the third slide surface 54 of the contact piece 23*c* of the second support member 23 at a large interval X2 from the center line OX in the X-axis direction of the carriage 5. Moreover, in FIG. 13, one pair of second sidable projection sections 65*a* and 65*b* formed on both ends of the clamping body 62 is symmetrically arranged about the center line OX in the X-axis direction at an interval X3 (<X2) from the center line OX in the X-axis direction and pushed resiliently from the side facing the first slidable projection sections 60*a* and 60*b* with the contact piece 23*c* therebetween. Therefore, a force trying to rotate the carriage 5 about the Z-axis with the function of the component force F4 in the X-axis direction caused by the timing belt 24 when the carriage 5 starts moving in the main scanning direction (X-axis direction) (when the carriage moves from a stationary state by receiving acceleration) can be efficiently received by one pair of first sidable projection sections 60*a* and 60*b* spaced from each other in the left-and-right direction, one pair of second slidable projection sections 65*a* and 65*b*, and the third slide surface 54. As a result, it is possible to prevent a change in the posture of the carriage 5 about the Z-axis, and it is possible to ensure stable movement of the carriage 5 in the main scanning direction.

The guide groove 85 which has an open top and is configured to allow the passage of the encoder strip 47 in the X-axis direction is integrally formed on the upper surface of an upper lid 66 made of a synthetic resin for covering the upper surface of the holder body 61 of the carriage 5. Placed in the middle of the guide groove 85 is the photo-coupler 61*c* capable of passing while sandwiching the encoder strip 47 (see FIGS. 7 to 12). Note that both ends of the encoder strip 47 are stretched over support pieces 86 rising from both the left and right ends of the second support member 23.

A control board (not shown), which outputs a predetermined drive signal to the recording head 4 upon receipt of a signal from the flexible flat cable 40, is provided between the connection support section 61*b* and the upper lid 66 detachable from the upper surface of the holder body 61. Detachment of the upper lid 66 is required to perform maintenance such as replacement of the control board or the ink supply tubes 20*a*-20*d* to be described later.

Next, the following description will explain in detail the arrangement and structure of the flexible ink supply tubes 20 which are always joined to the respective ink cartridges 19 stored in the ink storing section 15 and the recording head 4 of the recording section 7.

In this embodiment, the ink supply tubes 20*a*-20*d* are mutually independent tube bodies, and all the ink supply tubes 20*a*-20*d* have the same length.

As shown in FIGS. 3 to 5, a plurality of (four in this embodiment) ink supply tubes 20 are extended from one end (the right end in FIG. 4) on the upper surface of a lower cover body 29 to the direction of the other end (the left end in FIG. 4) along the X-axis direction. At this time, the base portions of the ink supply tubes 20*a*-20*d* are all aligned in an almost vertical direction.

The mid portions of all the ink supply tubes 20*a*-20*d* cross over the second support member 23 from the lower cover body 29, and the mid portions are bound through a movable binding member 71 in the form of a wire. All the ink supply tubes 20*a*-20*d* are curved and twisted at the mid portion, and the end portions thereof are connected almost horizontally in a line to the tube connection section 72 provided on one end (the left end in FIGS. 4 and 5) of the connection support section 61*b*.

In this embodiment, the flexible flat cable 40 transmits from a controller (not shown), which is provided in the recording apparatus main body 2, an instruction signal to selectively eject ink droplets from the nozzles of the recording head 4 carried on the carriage 5. The flexible flat cable 40 is arranged in an area where the ink supply tubes 20*a*-20*d* pass when the carriage 5 moves reciprocally in the X-axis direction (main scanning direction) so that it is substantially parallel to the direction in which the ink supply tubes 20 are extended and that the wide surface of the flexible flat cable 40 runs along the vertical direction (see FIGS. 4 and 5). Moreover, the curved portion of the flexible flat cable 40 is positioned within a radius of the curved portions of the ink supply tubes 20*a*-20*d*.

Since the ink supply tubes 20*a*-20*d* have the curved portions, rotational moment about the Z-axis acts on the tube connection section 72 and consequently on the carriage 5 due to the restoring forces of the ink supply tubes 20*a*-20*d* trying to increase the radius of the curved portions. This action force can be efficiently received by one pair of first slidable projection sections 60*a* and 60*b* spaced from each other in the left-and-right direction, one pair of second slidable projection sections 65*a* and 65*b*, and third slide surface 54. As a result, it is possible to prevent a change in the posture of the carriage 5 about the Z-axis, and it is possible to ensure smooth movement of the carriage 5 in the main scanning direction.

According to this embodiment, the projected shape of the carriage onto a plane including the main scanning direction and sub-scanning direction is substantially symmetrical about the center axis of the carriage in the main scanning direction, and the position of center of gravity of the carriage on the plane including the main scanning direction and sub-scanning direction is adjacent to the third slide surface. It is therefore possible to decrease rotational moment about the Z-axis through the position of center of gravity with respect to the third slide surface, and the posture of the carriage is stabilized against the rotational moment about the Z-axis. Further, it is possible to decrease the energizing force of the resilient member for resiliently energizing one pair of second slidable projection sections to the third slide surface.

According to this embodiment, the carriage is joined to a part of the endless belt provided on the upper side of the second support member along the main scanning direction so that it is movable along the main scanning direction, and the joint section of the endless belt and the carriage is positioned between the second slide surface and the third slide surface in the sub-scanning direction. Therefore, the slide resistance during movement of the carriage with respect to the third slide surface is reduced, and it is possible to decrease the tensile force of the endless belt and reduce the size of the CR motor.

According to this embodiment, since the height position of the joint section is higher than the mount section of the endless belt with respect to the second support member, a component force in the vertical direction of tension of the endless belt acts on the carriage at the position of the joint section of the carriage when the carriage starts moving in the main scanning direction (when the carriage moves from a stationary state by receiving acceleration). In this case, rotational moment trying to rotate about the Y-axis with the component force (a force trying to rotate the carriage about the Y-axis with the function of the component force in the vertical direction caused by the endless belt) can be efficiently received by the first slide surface and the second slide surface. As a result, it is possible to prevent a change in the posture of the carriage about the Y-axis, and it is possible to ensure stable movement of the carriage in the main scanning direction.

According to this embodiment, since the height position of the center of gravity of the carriage and the height position of the joint section are substantially the same, it is possible to prevent a change in the posture of the carriage about the Y-axis, and it is possible to ensure stable movement of the carriage in the main scanning direction even when the carriage starts moving in the main scanning direction (when the carriage receives the influence of acceleration).

According to this embodiment, since the height position of the center of gravity of the carriage is within the width of the endless belt in the joint section, it is possible to prevent a change in the posture of the carriage about the Y-axis, and it is possible to ensure stable movement of the carriage in the main scanning direction even when the carriage starts moving in the main scanning direction (when the carriage receives the influence of acceleration).

According to this embodiment, the flexible ink supply tubes for supplying the inks from the ink storing section provided at a stationary position of the image recording apparatus are connected to one side of the carriage in the sub-scanning direction, and the connection section of the ink supply tubes and the carriage is positioned between the joint section and the second slide surface in the sub-scanning direction. Therefore, when the position where the connected ink supply tubes are curved with the movement of the carriage changes, toque about the Z-axis acts on the carriage. However, since the carriage slides on the third contact surface through the one pair of first slidable projection sections, it is possible to effectively receive the toque about the Z-axis. As a result, it is possible to ensure stable movement of the carriage in the main scanning direction.

According to this embodiment, the carriage comprises the first leg section that comes into contact with the first slide surface, and one pair of second leg sections that comes into contact with the second slide surface so that the first leg section and the second leg sections protrude from the lower surface of the carriage. Since the first leg section and the second leg sections are arranged to form the vertexes of a triangle stretched over the first and second support members, the carriage can move in the main scanning direction while being supported on both the support members only by its own weight. Moreover, a force trying to rotate the carriage about the Y-axis with the function of the component force F in the X-axis direction through the joint section caused by the endless belt when the carriage starts moving in the main scanning direction (X-axis direction) (when the carriage moves from a stationary state by receiving acceleration) can be efficiently received by one pair of second leg sections spaced from each other in the left-and-right direction and the second slide surface. As a result, it is possible to prevent a change in the posture of the carriage about the Y-axis, and it is possible to ensure stable movement of the carriage in the main scanning direction.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image recording apparatus comprising:

a carriage which carries a recording head and moves reciprocally in a main scanning direction, said recording head having a nozzle and being capable of recording an image on a recording medium by ejecting ink from the nozzle;

a first support member and a second support member disposed on an upstream side and a downstream side, respectively, in a sub-scanning direction orthogonal to the main scanning direction, said first support member and said second support member having a first slide surface and a second slide surface, respectively, for supporting said carriage slidably, said first slide surface and said second slide surface being formed on substantially horizontal upper sides of the respective first support member and second support member to be parallel to a surface of said recording head where the nozzle is formed, wherein said second support member is provided with a third slide surface which stands substantially orthogonal to the second slide surface and is positioned between the first slide surface and the second slide surface, said carriage comprises one pair of first slidable projection sections slidable in contact with the third slide surface and one pair of second slidable projection sections facing the first slidable projection sections with the third slide surface therebetween, at a suitable interval in the main scanning direction, and said carriage further comprises a resilient member for resiliently energizing the second slidable projection sections, via a biasing force, toward the third slide surface and the downstream side in the sub-scanning direction, respectively, wherein the second slidable projection sections are disposed in the resilient member at a suitable interval in the main scanning direction; and an endless belt provided on an upper side of said second support member along the main scanning direction, wherein said carriage is joined to a part of said endless belt at a joint section and is movable along the main scanning direction, and said joint section is positioned between the second slide surface and the third slide surface in the sub-scanning direction.

2. The image recording apparatus according to claim 1, wherein a height position of the joint section is higher than a mount section of said endless belt with respect to said second support member.

3. The image recording apparatus according to claim 1, wherein a height position of center of gravity of said carriage and a height position of the joint section are substantially the same.

4. The image recording apparatus according to claim 1, wherein a height position of center of gravity of said carriage is within a width of said endless belt in the joint section.

5. The image recording apparatus according to claim 1, further comprising:

an ink storing section at a stationary position of the image recording apparatus; and a flexible ink supply tube for supplying ink from said ink storing section, wherein said ink supply tube is connected to one side of said carriage in the sub-scanning direction, and a connection section of said ink supply tube and said carriage is positioned between the joint section and the second slide surface in the sub-scanning direction.

6. The image recording apparatus according to claim 1, wherein a first leg section that comes into contact with the first slide surface and one pair of second leg sections that comes into contact with the second slide surface are provided on said carriage so that the first leg section and second leg sections protrude from a lower surface of said carriage, and the first leg section and the second leg sections are arranged to form vertexes of a triangle stretched over said first and second support members.

7. The image recording apparatus according to claim 1, wherein said one pair of first slidable projection sections and said one pair of second slidable projection sections are respectively arranged at a suitable interval in the main scanning direction.

8. The image recording apparatus according to claim 1, wherein a projected shape of said carriage onto a plane including the main scanning direction and the sub-scanning direction is substantially symmetrical about a center axis of said carriage in the main scanning direction; and a position of center of gravity of said carriage in the plane including the main scanning direction and the sub-scanning direction is adjacent to the third slide surface with the resilient member being interposed therebetween.

* * * * *